US012313386B2

(12) United States Patent
Citron

(10) Patent No.: US 12,313,386 B2
(45) Date of Patent: May 27, 2025

(54) MODIFYING A PROJECTILE CASING

(71) Applicant: Mannis Operations LLC, Jupiter, FL (US)

(72) Inventor: Jeffrey Citron, Jupiter, FL (US)

(73) Assignee: Mannis Operations LLC, Jupiter, FL (US)

( * ) Notice: Subject to any disclaimer, the term of this patent is extended or adjusted under 35 U.S.C. 154(b) by 0 days.

(21) Appl. No.: 18/385,336

(22) Filed: Oct. 30, 2023

(65) Prior Publication Data

US 2025/0137766 A1 May 1, 2025

(51) Int. Cl.
*F42B 33/10* (2006.01)
*F42B 33/00* (2006.01)

(52) U.S. Cl.
CPC ..... *F42B 33/10* (2013.01); *F42B 33/001* (2013.01)

(58) Field of Classification Search
CPC ..... F42B 33/00; F42B 33/001; F42B 33/005; F42B 33/10; B21K 21/04; B21J 13/02
USPC ..... 86/24, 37; 72/367.1, 370.04, 370.13, 72/462, 467
See application file for complete search history.

(56) References Cited

U.S. PATENT DOCUMENTS

| | | | | |
|---|---|---|---|---|
| 3,143,919 | A | 8/1964 | Estes | |
| 3,363,296 | A | 1/1968 | Duffield | |
| 3,440,923 | A * | 4/1969 | Purdie | F42B 33/10 86/43 |
| 3,705,515 | A * | 12/1972 | Lee | B21K 21/16 86/19.5 |
| 4,723,472 | A | 2/1988 | Lee | |
| 4,836,078 | A | 6/1989 | Lee | |
| 5,635,661 | A | 6/1997 | Tuftee | |
| 5,649,465 | A * | 7/1997 | Beebe | F42B 33/10 86/24 |
| 6,050,169 | A | 4/2000 | Voros | |
| 6,397,720 | B1 * | 6/2002 | Fox | F42B 33/10 86/24 |
| 9,395,155 | B1 | 7/2016 | Bockmon | |
| 9,464,871 | B2 | 10/2016 | Bay | |
| 9,574,860 | B1 | 2/2017 | Mobley | |
| 10,794,676 | B1 | 10/2020 | Aerni | |
| 11,067,375 | B1 | 7/2021 | Helgason | |
| 11,333,473 | B2 | 5/2022 | Carper et al. | |
| 2011/0114725 | A1 | 5/2011 | Young | |
| 2012/0160081 | A1 * | 6/2012 | Beebe | F42B 33/10 86/24 |
| 2020/0056870 | A1 | 2/2020 | Carper et al. | |

FOREIGN PATENT DOCUMENTS

| | | | |
|---|---|---|---|
| WO | 9736701 | A1 | 10/1997 |

* cited by examiner

*Primary Examiner* — James S Bergin
(74) *Attorney, Agent, or Firm* — Davis Wright Tremaine LLP

(57) ABSTRACT

An apparatus, system, computer-readable medium, process, die, or combination thereof to modify a projectile casing. For example, a die and mandrel can be used to shape, resize, or otherwise modify a projectile casing. A die can include different portions or sections, where the portions or sections are designed to shape or size different portions of the projectile casing such as the neck, shoulder, or body of a projectile casing. A method to insert a projectile casing into a die, where the die already includes a mandrel, and then extracting the mandrel while the die and projectile casing are held in place.

6 Claims, 36 Drawing Sheets

MODIFYING A PROJECTILE CASING

CROSS REFERENCE TO RELATED APPLICATIONS

This application incorporates by reference for all purposes the full disclosure of co-pending U.S. patent application Ser. No. 18/385,339, filed concurrently herewith, entitled "COMPENSATING FOR TEMPERATURE OF A BARREL IN BALLISTICS" and U.S. patent application Ser. No. 18/385,341, filed concurrently herewith, entitled "COMPENSATING FOR PROJECTILE WEIGHT IN BALLISTICS."

TECHNICAL FIELD

An apparatus, system, die, device, computer-readable medium, and/or process to modify physical attributes of a projectile casing to improve metrics, such as consistency, and shape, of the modified projectile casing. For example, a bullet casing that is circular, symmetrical, smooth, and consistent bullet likely results in a shooter having a more predictable shot and better aim than a bullet casing that is asymmetrical or has defects in it.

BACKGROUND

Ballistics includes the science of projectiles and firearms, such as the motion of objects (e.g., rounds of projectiles) that are driven forward. For example, ballistics includes the study of effects of firing a round for a projectile, where the round comprises a cartridge including a casing and the projectile (e.g., bullet, slug, or shot). There are many factors to consider when a firearm fires a projectile according to ballistics. For example, the exit speed of the bullet from a barrel, the shape of the bullet, the size of the bullet, and the material of the bullet can affect the round's trajectory. Also, properties of the barrel such as length, material, width, and design can affect the firing of a round, impacting the result. These are various factors a marksman can consider while aiming. However, a marksman can still consider these factors and have performance affected (e.g., missing a target, having less accuracy and/or consistency), as there are many factors to consider when firing a projectile. Accordingly, there exists a need to improve firing a round of a projectile.

DETAILED DESCRIPTION

Figure 1:
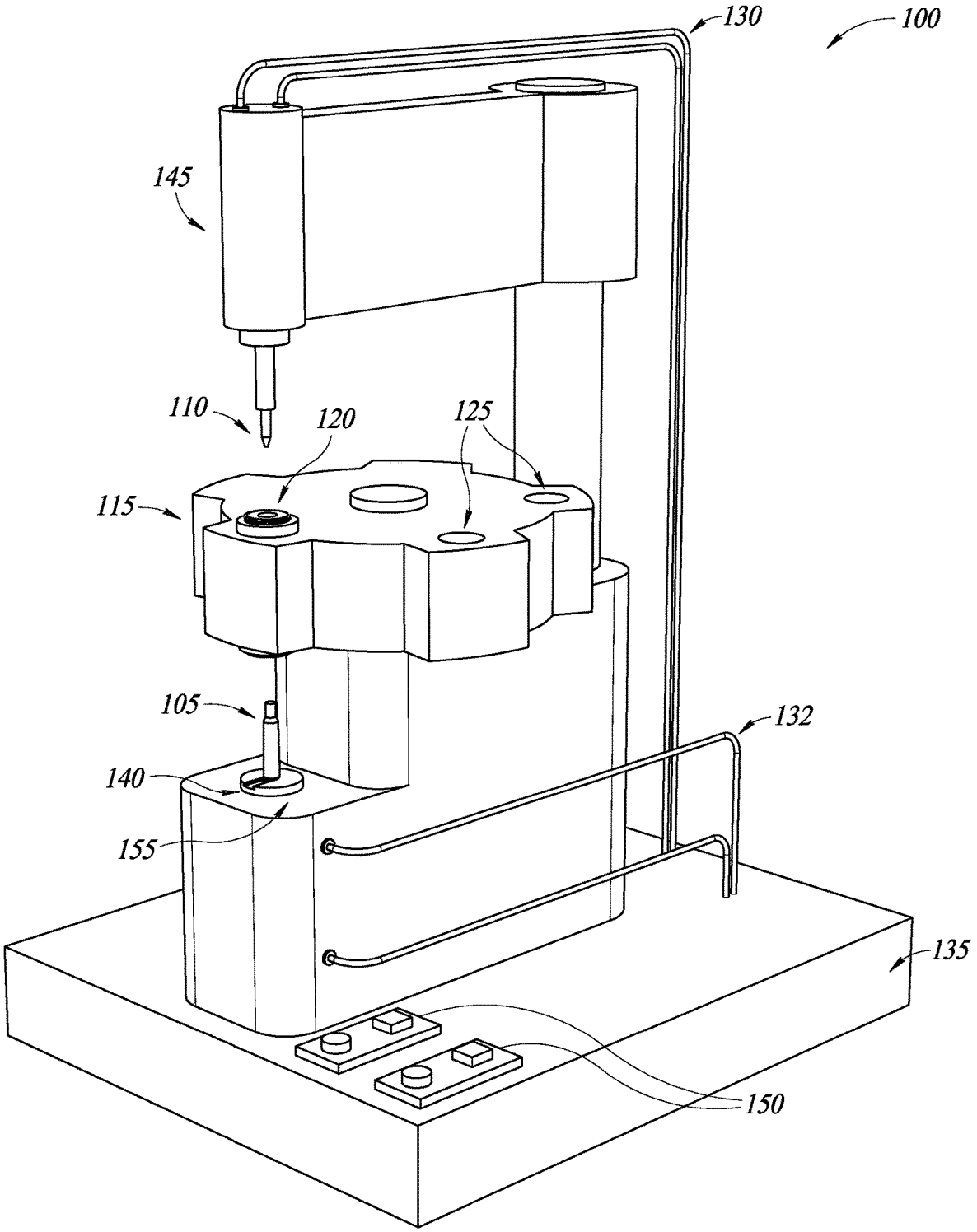
FIG. 1 illustrates a schematic diagram for a system for modifying a projectile casing in accordance with at least one embodiment.

A round for a projectile includes a cartridge, further comprising a casing and the projectile (e.g., bullet, slug, and/or shot). A casing can be a component of a cartridge that provides the cartridge with its shape and serves as a housing for other functional components. For example, a casing provides a container for propellant powders (e.g., gun powder), serves as a protective shell, and provides support for holding and securing a bullet. A casing can be configured to hold a bullet until it is fired. A casing can be referred to as "brass" (e.g., after a gun is fired, the brass of the casing is expelled and can be reloaded to create another cartridge) or a "shell casing." A casing can be comprised of or include metal such as brass, aluminum, steel, brass-plated, nickel-plated brass, polymer plastics, 3-dimensional (3D) printing materials, and combinations thereof. A casing can be included in a cartridge, which can be a unit of ammunition made up of a cartridge case, primer (e.g., rimfire or centerfire), powder, and a projectile (e.g., bullet, slug, and/or shot). A cartridge can also be referred to as a "round" or "load." A case can include different shapes and be configured to secure different types of bullets. For example, bullet casing can have an opening to hold and receive a bullet, bands made from different material that wrap around a casing (e.g., to provide fortifying strength).

A casing can have several purposes. A casing can hold the bullet sufficiently to ensure that it does not get pushed back when the round is chambered and grip it long enough for the pressure inside to build to the required level when the powder charge is ignited by the primer. A bullet casing can fit in a chamber of a barrel (e.g., both before and after firing), so that it can be chambered and extracted (e.g., expelled) without resistance. A casing can attach to the projectile (e.g., bullet and/or shot) at a front end of a cartridge [e.g., cartridges designed for pistols, rifles (semi-automatic or automatic), shotguns, guns (to include artillery)] or inside of a cartridge (e.g., wadding/sabot containing either a number of shot or an individual slug for a shotgun shell). Embodiments, when describing an implementation for a cartridge for a bullet casing, may also be used in an implementation of reforming brass of an expelled shotgun shell to be reloaded with a slug or shot. A projectile (e.g., bullet, slug, or shot) casing can align a projectile with a barrel bore to the front, hold primer (e.g., centerfire boxer, centerfire berdan, or rimfire) at a back end, which receives an impact from a firing pin, and be responsible for igniting the main propellant charge inside the case.

The casing may be designed for a single use, for more than one use (e.g., be reloadable), or both. Casings can be acquired separate from the bullet, such as for self-loading (e.g., hand-loading to perform precision shooting), and/or be reloadable once fired and expelled from a barrel. For example, casings which can receive a replaceable primer include centerfire primers.

In order to load a projectile into a case, the projectile is seated into a casing, such as in the instance of reloading (though it may also be used in preparation of self-loading a projectile). If a previously expended round (e.g., shot by a gun) used a projectile casing, the projectile casing may have expanded beyond a desired casing diameter or acquired a defect (e.g., donut, misshaped hole, incorrect thickness). For example, a casing is typically a small amount narrower than the bullet diameter to create a secure fit (e.g., semi-tight, tight, clamped fit), where the bullet itself may be held in position by friction from the bullet casing. For example, a casing can be a small amount narrower than the bullet itself (e.g., if the bullet has a section that is 0.38 inches in diameter that is supposed to be inserted into a casing, the casing can be, e.g., 0.379, 0.378, 0.375, or 0.37 inches) and when the bullet is seated, the bullet is fit into the brass.

However, in instances where the manufacturer created an anomalous or defective casing, the casing may be narrower than the desired diameter. The casing may need to be widened at the mount to allow the projectile (e.g., bullet) to be seated to the correct depth. Also, in at least one embodiment, the disclosed technology can be used to narrow a casing diameter (e.g., decrease width of hole in casing that is used to hold or secure bullet in place with friction). For example, if a casing is used (e.g., fired in a gun), the casing diameter may have increased such that it is too wide to securely hold a bullet.

The disclosed technology here can include a die with an interior section that is designed to shape (e.g., push in, narrow, smooth, or make round) a neck or shoulder area of a casing that has been widened (by being shot) too much (e.g., it is too wide to secure or hold a bullet). For example, a mandrel that is narrower than a casing opening can be inserted into a die, and the die can be sized to include an interior section that is to narrow a diameter of a casing (e.g., a hole to secure a bullet) such that a casing is inserted into a die that already has a mandrel in it. In at least one embodiment, a bullet is held in place at the open end of the projectile casing by a tight fit, e.g., a diameter of the bullet is slightly larger than the inside diameter of the casing, which creates a press fit. In at least on embodiment, an area where the bullet is seated in the casing is called the neck.

As the casing moves into the die, its neck and/or shoulder sections will be shaped and/or sized (e.g., adjusted length or thickness) by pushing into the walls of the die (e.g., its interior neck and/or shoulder sections); also, the mandrel will be in place while the casing is being pushed into the die such that the mandrel behaves as a center guiding post as the casing slides up into the die. The mandrel can also behave as an interior wall to keep the walls of the casing in a uniform, circular, or substantially concentric shape. After the casing is fully inserted into the die (where the mandrel was in the die before the casing was inserted into the die), the mandrel can be extracted from the die such that the die holds, secures, or otherwise keeps the casing in place such that the friction and pressure between the mandrel walls, the die walls, and the casing walls cause the casing to be shaped and/or resized. In at least one embodiment, the die is held or secured in place by a support structure and the casing is held by a support structure while the mandrel is being extracted from the casing and die.

In at least one embodiment, the disclosed technology includes a set of mandrels (e.g., 2, 3, 4, 5, 100, or more), where each mandrel has a different diameter (e.g., increases diameter from the first mandrel to the second mandrel, and from second mandrel to third mandrel, etc.). A person can increase or decrease a diameter of a projectile casing by using the set of mandrels (e.g., by using the mandrels in an order that increases in thickness or diameter, the mandrels can be used to gradually increase the width of a casing; alternatively, the mandrels could be used to decrease the width of a casing by changing the mandrels to select mandrels that are gradually decreasing in width). Also, the disclosed technology includes a die system such that different parts of the die can be interchangeable. For example, a die may have two sections where one section is configured to shape or size a neck (and/or shoulder) and another section is configured to shape or size a body of a projectile casing. The interior parts of the die can be changed to include walls of a different shapes or lengths such that a operator can switch the interior parts or a die or a sections of a die to gradually increases or decrease width, lengths, or other physical properties of the projectile casing. Also, the set of dies can be used with a set of mandrels (e.g., in combination) so that an operator can increase or decrease the size, length, or shape of projectile casings.

While measurements of projectiles and projectile casing are provided in this application in inches, they can also be provided in millimeters or another measuring system. Also, the disclosed technology disclosed here in can be applied to bullets of different sizes, shapes, and designs as well as to projectile casings with different sizes, shapes, and designs (e.g., an operator would change the mandrel, change the die, or change the interior parts of the die for a desired outcome, size, or shape of the projectile casing). The brass, being a soft metal, can have the projectile seated into the casing this way. The casing is narrow enough to be seated in the action of the firearm, but the rim of the casing wide enough such that the casing will not pass down the length of the barrel.

After seating a projectile in the casing, however, the material of the casing (e.g., brass) can flow (e.g., move) around the outside of the bullet, which can make the round slightly wider than permitted for the caliber being loaded. In at least one embodiment, a bullet is held in place by sheer friction between the casing and bullet and for some rounds, friction from the seating process is sufficient for providing enough hold to keep the bullet in a stable position before and while shooting a gun. When a bullet is seated into a case and the base of the bullet presses against or into a doughnut, the throat of the case is reduced, which causes the case to tighten firmly around the bullet and pressure will rise on the bullet, which can impact the trajectory of a bullet when it is fired.

However, in preparation of loading a projectile into a case, a casing may be reshaped (such as for reloading a used casing) and/or confirmed to be of a preferred shape (such as to perform self-loading in precision shooting). A casing to be reloaded may not be adequately shaped or have an opening capable of receiving a bullet due to the pressure (e.g., mechanical, concussion, vibration) or heat of firing a round, needing to be reshaped. Also, in the mass-production of casings by manufacturers it is possible a casing deviates from a preferred shape, in which case the deviating case may need to be reshaped.

In at least one embodiment, a mandrel is used to shape the case at the receiving end as it is in a mold of the preferred shape of the casing. If done improperly, this can affect negatively metrics measuring performance (e.g., accuracy and/or consistency) of a fired projectile. For example, if brass is hard, it may lose its flexibility. The case neck may be too thick and expand too much in relation to the chamber, the case shoulders are pushed back too far by a sizing die. Most case walls have a thin and thick side. The amount of stress occurring to shape the casing may differ between the thin side and the thick side, which may cause the casing to bend when it is extracted from a die (e.g., a mold to resize a projectile casing). Further, an angle by which the casing is extracted or improper placement when setting a round to be reshaped may also cause deviations in shaping a casing. These irregularities in a casing may cause the gas, when firing a round, to unevenly distribute across a projectile and impact the spin and trajectory of the projectile.

An apparatus, system, computer-readable medium, die, computer-implemented method, and/or process to modify shape or other physical attributes of a casing for a projectile to improve performance metrics (e.g., accuracy and/or consistency) of firing a round of a projectile with the modified casing.

In at least one embodiment, the disclosed technology includes a method for modifying the shape of a projectile casing (e.g., projectile case). The method can be performed by a human, machine, or a combination thereof. The method can include: inserting a mandrel into a die, securing a bullet casing on a base (e.g., supporting structure to hold a bullet casing); inserting the bullet casing in a die by moving the base towards the die, wherein the die includes a region to shape a neck section of the bullet casing, wherein inserting the bullet casing into the die includes moving the bullet casing towards the die while the die is secured to a support structure; wherein the bullet casing is fully inserted into the die, inserting, at least partially. The method can also include inserting a mandrel (e.g., a shaft, spindle, cylindrical rod, or other protruding structure) into the interior of the die and inserting the bullet casing, wherein inserting the bullet casing into the die includes a mandrel expanding the neck section of the casing into the die; and after the bullet casing is inserted into the die and expanded by the mandrel, while the bullet casing is held by the base, the mandrel is extracted away from the bullet casing, wherein extracting the mandrel away from the bullet casing includes moving the mandrel away from a base section of the bullet casing towards the hole of the bullet casing until the mandrel is completely outside of the bullet casing. In at least one embodiment, because the die is secured to a support structure or base (e.g., metal holder, metal ring), the die includes interior portions or sections that are configured to shape or size a casing, and the die is held in place while the mandrel is extracted away (e.g., up) from the projectile casing that is fully or substantially (e.g., more than 50% such as 80% or 90%) fit inside of the die such that the die completely restricts the motion of the projectile casing while the mandrel is extracted the projectile casing, its hole, its neck, its shoulder, and/or its body are shaped and resize based on uniform pressured applied by the die (e.g., its interior sections) while the mandrel is extracted.

In at least one embodiment, the disclosed technology includes a die. A die can also be referred to as a "case forming" or "resizing die." Dies can be used to shape projectile casings (e.g., form brass cases). Dies can be used to reshape already fired casings or casings that are "fresh" (e.g., never been fired). Dies can also be used to confirm the shape of casings used to perform precision marksmanship or fix anomalous casings from a manufacturer. As an example, if a casing from a manufacturer is too narrow, the casing may be widened using one or more dies, progressively expanding the casing by repeating a process with subsequent greater in diameter dies. Dies can be composed on multiple parts (e.g., a two piece die with multiple sets). Dies can correct, modify, or otherwise change length, size, and shaping of bullet casings that have already been fired or have never been fired (e.g., produced by a manufacturer but not used yet). Dies can be composed of metal (e.g., steel), carbide, plastics, or a combination thereof.

The disclosed technology can be used for cartridges designed for different types of projectiles, such as those fired by gun (e.g., of a particular caliber or gauge), though the disclosed technology may also be used for other guns, such as projectile cartridges for artillery. A type of gun can impact ballistics associated with firing a bullet. A gun can be any type of firearm used by an individual, such as a handgun (e.g., pistol), shotgun (e.g., slugs or shot), or rifle (semi-automatic or automatic). A gun may also include crew-served equipment to fire a projectile from a barrel, such as artillery or naval guns. In some embodiments, the disclosed technology works with guns (e.g., rifles) used for precision shooting (e.g., long range).

Example embodiments are described herein with reference to the accompanying drawings. The figures are not necessarily drawn to scale. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open-ended in that an item or items following any one of these words is not meant to be an exhaustive listing of such item or items or meant to be limited to only the listed item or items. It should also be noted that as used herein and in the appended claims, the singular forms "a," "an," and "the" include plural references unless the context clearly dictates otherwise.

In the following description, various working examples are provided for illustrative purposes. However, it is to be understood the present disclosure may be practiced without one or more of these details. Reference will now be made in detail to non-limiting examples of this disclosure, examples of which are illustrated in the accompanying drawings. The examples are described below by referring to the drawings, wherein like reference numerals refer to like elements. When similar reference numerals are shown, corresponding description(s) are not repeated, and the interested reader is referred to the previously discussed figure(s) for a description of the like element(s).

FIG. 1 illustrates a schematic diagram for a system 100 for modifying a projectile casing 105 in accordance with at least one embodiment. In at least one embodiment, a system 100 includes projectile casing 105, mandrel 110, die plate 115, retainer and die component 120, retainer receiving space 125 of the die plate, and/or receiving base 140. A projectile casing 105 may be modified based, at least in part, on a mandrel being extracted away from a projectile using a lever, such as by using a simple machine and/or hydraulics, as illustrated by system 100. In at least one embodiment, a system 100 as an example of modifying a projectile casing 105 using hydraulics includes projectile casing 105, mandrel 110, die plate 115, retainer and die component 120, retainer receiving space 125 of the die plate, hydraulics 130 and/or 132 to position mandrel and/or casing, base comprising hydraulic components 135, receiving base 140, hydraulic cylinders 145 and 155 to position mandrel and projectile casing, and/or hydraulic controls 150. A system 100 may be comprised of one or more subsystems which perform modification of a projectile casing 105 and/or otherwise perform operations described herein. In at least one embodiment, die plate 115 is a support structure. In at least one embodiment, support structure includes or is coupled to a rotating wheel, motor-driven, or other mechanical or electrical motor, which can be means for rotating a die plate and aligning a die with a mandrel.

In at least one embodiment, die plate 115 is used as a means for rotating and/or aligning a mandrel. For example, to rotate a die wheel and reshape a bullet casing using a system 100 (e.g., also referred to as a "die press" or "press" or "reloading press" to reshape a bullet casing) is securely mounted to a sturdy workbench, and an appropriate die set for a bullet caliber is installed in the die plate 115. In at least one embodiment, adjusting a die is accomplished through screwing it into system 100 when a ram is fully raised, and then locked it in place using the lock ring.

System 100 may modify a projectile casing 105 to improve accuracy and/or consistency of a projectile towards an intended target and/or direction. As an example, a projectile casing 105 without modification may include factory defects, concussion damage if a previously expended round, and/or not of a preferred shape (e.g., asymmetrical, length, angle of casing 105 shoulders). For example, concussion damage on a casing may include both the outward pressure against projectile casing (e.g., causing it to expand) and also the sudden contraction of pressure as the projectile exits the barrel (e.g., what causes a semi-star shaped end of an expended round). Though a projectile casing 105 does not typically leave out the muzzle of the rifle, as the projectile does when a cartridge is fired, the casing's construction contributes to the gas pressure being evenly distributed amongst the projectile. If a casing 105 is uneven, such as a casing's shoulders directed inward at a different angle, a dent in the casing, or even an inconsistency in length of casing 105 body or neck may cause pressure differences when firing the projectile. When the pressure is not uniform or not of a predicted value, which can be caused by the projectile casing's 105 shape, this may then impact the projectile's spin or velocity when exiting the barrel and thus may result in an irregular performance of the projectile. In at least one embodiment, the issue is exacerbated as external factors, such as the environment (e.g., temperature, wind, and/or moisture) and/or movement of the barrel, contribute to the outcome of the projectile's performance. By removing casing 105 irregularities, this isolates a controllable variable of the casing 105 design and may then lead to increased performance when other external variables are held constant. In at least one embodiment, a projectile casing 105 is secured to a hydraulic cylinder 155 to position casing 105. As an example, a groove (e.g., slot) may receive and secure casing 105 using a receiving base 140, such as groove receiving and securing casing by an extractor groove. As another embodiment, casing 105 may be secured in retainer and die component 120, where said retainer and die component is secured to receiving base 140 (e.g., fastener, adhesive, welding, threading). A receiving base 140 may attach to a hydraulic cylinder (e.g., hydraulic cylinder 155) and/or body of system 100 (e.g., base comprising hydraulic components 135). In at least one embodiment, a casing 105 includes one or more casings (e.g., casing 610 and/or 730) and/or portions (e.g., casing neck 734, casing shoulders 740, case neck, case shoulders 915, case body 920, case opening 925, case head 945, long neck casing 1705, outwardly bent casing 1805, doughnut shaped casing 1905, irregular elliptical casing 2005, irregular star shaped bent casing, and/or desired casing 1710, 1810, 1910, and/or 2010) thereof, as illustrated in FIGS. 1-21.

A projectile casing may be modified (or confirmed to be of a specific shape in hand-loading or otherwise self-loading of a projectile) using a mandrel to shape circular opening of the casing. This modification of the casing to a preferred shape, if done improperly at an incorrect angle or using an incorrect mold, could further cause projectile casing irregularities (e.g., not improve the casing to a desired shape). System 100 may perform a process (e.g., process illustrated in FIG. 21) which includes lowering a mandrel 110 into a die, partially inserting a projectile casing into a die, fully inserting the projectile casing into the die, the mandrel expanding the casing into the die, and then extracting the mandrel from the casing in a uniform manner, which may enable consistent and repeatable projectile casing modifications. In at least one embodiment, a mandrel (e.g., arbor) is a tool, which may be tapered, such as to forge, press, stretch, shape, and/or grip an object. The mandrel is of one or more materials (e.g., steel, carbonite, and/or brass) which are sufficiently hard to shape a projectile casing. Mandrel 110 includes a mandrel rod 510 and mandrel end 505 (see FIG. 5). A mandrel rod may then be connected to a body of a system, as illustrated by a hydraulic system 100 comprising a hydraulic cylinder 145 to position mandrel 110. An end 505 includes a mandrel end and/or a projectile modification end. Hydraulic cylinder 145 positions mandrel 110, inserting through die plate 115 and retainer and die component 120, such that a casing may then be modified based, at least in part, on inserting the casing, expanding it into the die (e.g., retainer and die component 120). For example, a mandrel 110 is lowered into the die, the projectile casing 105 moved into the die being formed by mandrel 110, and then the mandrel 110 extracted from the projectile casing 105 based, at least in part, on a hydraulic cylinder 145 using one or more hydraulic controls 150. In at least one embodiment, a mandrel 110 includes a mandrel (e.g., mandrel 905, 1107, 1111, 1115, 1130, 1225, 1305, and/or 1430; resizing mandrel system 720 and/or 825) and/or portions of a mandrel (e.g., mandrel end 505, 725, and/or 830; mandrel rod 510, 765, and/or 1605; mandrel base 710; cylindrical mandrel end 1500; ring mandrel end 1505; expander mandrel end 1510; mandrel rivets 1515; ribbed mandrel cylindrical end 1520; steps 1525; step mandrel end 1530; plain mandrel 1535; mandrel connector 1610; mandrel receiver 1620; mandrel movement 1625 and/or 1635; changeable mandrel end 1630; and/or mandrel lubrication 1650), as illustrated in FIGS. 2-16F.

System 100 may include a die plate 115. A die plate 115 may be connected to the body of the system (e.g., system 100). In at least one embodiment, a die plate 115 is rotatable, such as to change which retainer receiving space 125 of the die plate is in use. A die plate 115 may include one or more retainer receiving spaces 125. As an example, a die plate 115 positions and/or holds a die, such that a mandrel, if used, may shape an object (e.g., projectile casing 105) included in a die. If a die plate is rotatable, the die plate may include a mechanism to move and/or lock the die plate. For example, hydraulic or electrical components may cause movement of the die plate when initiated using a control (e.g., hydraulic controls 150, buttons, and/or circuit board controls) to align retainer and die component 120 with mandrel 110. Die plate 115 may be comprised of brass, aluminum, steel, brass-plated, nickel-plated brass, polymer plastics, 3-dimensional (3D) printed materials, or combinations thereof. Die plate 115 may be pivotally attached to a system (e.g., system 100) base. Die plate 115 may include retainer receiving space 125, which may then connect to retainer and die component 120. In at least one embodiment, die plate 115 includes a die plate (e.g., die plate 930) and/or portions (e.g., retainer receiving space 125) of a die plate, as illustrated in FIGS. 2-16F. In at least one embodiment, a process of extracting a mandrel from a die first prior to the object's extraction is applicable to other objects (e.g., brass objects) using a mandrel.

System 100 may include retainer receiving space 125 of die plate 115. Retainer receiving space 125 of die plate 115 includes an opening such that it may receive a retainer and die component 120. For example, a retainer receiving space 125 of the die plate may be cylindrical space in the die plate 115, such that it may receive a retainer and die component 120. Though illustrated as a cylindrical space, it may be another geometrical space (e.g., cuboid) that may receive a retainer and die component 120. In at least one embodiment, a die plate 115 includes one or more retainer receiving spaces 125. As an example, each retainer receiving space 125 may include a retainer and die component 120, such that the die plate 115 is rotatable to select a retainer receiving space 125 to be aligned with a mandrel 110. In at least one embodiment, a die plate 115 is interchangeable with a second die plate 115. A retainer receiving space may house a retainer and die component 120. A retainer and die component 120 may be housed (e.g., reside) in the retainer receiving space 125, such as in a permanent or replaceable manner. As an example, a retainer and die component 120 is housed in a retainer receiving space using a retainer fastener (e.g., fastener 215, see FIG. 2), threading, an adhesive and/or a method of attachment (such as those described herein). The retainer receiving space 125 may align with a retainer and die component 120, a projectile casing 105, and/or a mandrel 110.

System 100 may include hydraulics 130 and/or 132 to position mandrel 110 and/or projectile casing 105. As an example, hydraulics 130 position mandrel by proceeding towards retainer and die component 120 or extracting the mandrel from the retainer and die component 120, such as by hydraulics used according to a hydraulic controls 150. As an example, hydraulics 132 position casing 105 by proceeding towards retainer and die component 120 or extracting the casing from the retainer and die component 120, such as by hydraulics used according to hydraulic controls 150. In at least one embodiment, a system 100 may increase performance of modifying a casing through using hydraulics, 130 and/or 132, such as by moving mandrel 110 towards retainer and die component 120 and casing 105 (e.g., using hydraulic cylinder 145, shaping the casing), moving a casing 105 into a retainer and die component 120 partially (e.g., using hydraulic cylinder 155), moving a casing 105 body into a retainer and die component 120 (e.g., using hydraulic cylinder 155) including the mandrel 110 forming the casing into the die, extracting mandrel 110 from retainer and die component 120 and casing 105 (using hydraulic cylinder 145), and/or extracting casing 105 (e.g., using hydraulic cylinder 155). In at least one embodiment, hydraulics is the science of conveyance of liquids, such as a form of mechanical force and/or control (e.g., positioning casing 105, retainer and die component 120, and/or mandrel 110). In at least one embodiment, base comprising hydraulic components 135 includes components to use hydraulics to position casing 105, retainer and die component 120, and/or mandrel 110. As an example, base comprising hydraulic components includes a circuitry (e.g., circuit board) to receive signals from hydraulic controls 150 (e.g., buttons and/or lever to position casing 105, retainer and die component 120, and/or mandrel 110). In at least one embodiment, system 100 may repeat a process for more than one casing. A system 100 may also modify one or more casings using a process (e.g., process illustrated in FIG. 21). For example, one or more dies and mandrel may shape a casing using processes described herein simultaneously (e.g., 10 casings are inserted into 10 dies, shaped by 10 mandrels using methods described herein). In at least one embodiment, system 100 repeats a process (e.g., process illustrated in FIG. 21) for more than one size of die to shape a casing, such as by progressively increasing the diameter of the die for each iteration of modifying the casing.

In at least one embodiment, system 100 uses one or more processes described herein. For example, a process (or any other processes described herein, or variations and/or combinations thereof) is performed under control of one or more systems (e.g., system 100) or individuals. System 100 may include a computer system configured with computer executable instructions and implemented as code executing collectively on one or more processors, by hardware, software, or combinations thereof. Code (e.g., computer executable instructions, one or more computer programs, or one or more applications) may then be stored on a computer-readable storage medium in form of a computer program comprising a plurality of computer-readable instructions executable by one or more processors. In at least one embodiment, a computer-readable storage medium is a non-transitory computer-readable medium. In at least one embodiment, at least some computer-readable instructions usable to perform process are not stored solely using transitory signals (e.g., a propagating transient electric or electromagnetic transmission). A non-transitory computer-readable medium does not necessarily include non-transitory data storage circuitry (e.g., buffers, caches, and queues) within transceivers of transitory signals. System 100 may be performed at least in part on a computer system such as those described elsewhere in this disclosure. In at least one embodiment, system 100 using logic (e.g., hardware, software, or a combination of hardware and software) performs a process (e.g., process illustrated in FIG. 21). In at least one embodiment, a system 100 comprises: a base to support and secure a projectile casing; a support structure to receive a die, wherein the die includes a region to shape a neck section of the projectile casing; a mandrel, wherein at least a portion of the mandrel has a diameter that is a desired width of a hole in the projectile casing; means for (e.g., rods, screws, a person who can use a tool to place the mandrel inside the die, a machine that connects to the mandrel and lowers it or inserts it into the die through a hole in a center of the die, or other mechanical structure that can guide a mandrel into a die) at least partially inserting the mandrel into the die, means for moving (e.g., hydraulic pump, electronic motor, lever, pulley, or other mechanical, electrical or hydraulic system that raises, moves, or increases a height of a base) the base towards the support structure when the die is inserted into the support structure; and/or means for (e.g., hydraulic pump, electronic motor, lever, pulley, claw, clip, engagement element, or other mechanical, electrical or hydraulic system that pulls, lifts, moves, or slides a mandrel out of a die) extracting the mandrel away from the projectile casing, wherein extracting the mandrel away from the projectile casing includes moving the mandrel away from a base section of the projectile casing towards the hole of the projectile casing until the mandrel is completely outside of the projectile casing. In at least one embodiment, a support structure includes a die plate, metal ring with holes in it to receive dies, or other rigid structure that is configured to hold, secure, or otherwise support in holding dies. In at least one embodiment, means for moving a base or inserting the projectile casing into a die can include a hydraulic pump, electronic motor, lever, pulley, or other mechanical, electrical or hydraulic system that raises, moves, or increases a height of a base or any combination thereof as shown in, e.g., FIGS. 1, 2, 3, 4, 5A, 5B, 6, 8A, 8B, 9A, 9B, 9C, 9D, 9E, 9F, 10A, 10B, 10C, 10D, and 10E. In at least one embodiment, means for extracting a mandrel from projectile casing including projectile casing can include clip, clamp arm, hydraulic pump, electronic motor, lever, pulley, or other mechanical, electrical or hydraulic system that raises, moves, or increases a height of a base, or any combinations thereof as shown in, e.g., FIGS. 1, 2, 3, 4, 5A, 5B, 6, 8A, 8B, 9A, 9B, 9C, 9D, 9E, 9F, 10A, 10B, 10C, 10D, and 10E. In at least one embodiment, means for extracting a mandrel from a die can include manual extraction, hydraulic or pneumatic systems to apply a controlled force for mandrel retraction, motor-driven mechanisms, and spring-loaded mechanisms. In at least one embodiment, means for extracting a mandrel inserted in a die include magnetic and/or electrical retrieval (e.g., while a die is held in place by a support structure, using electrically powered magnet to extract the mandrel from the die).

FIGS. 2-4, 5A, and 5B illustrate a schematic diagram for a system (e.g., system 100) for modifying a projectile casing in more detail in accordance with at least one embodiment. For example, FIGS. 2-5B progress as if assembling a system, using previously detached parts, which can be used to modify a casing. FIGS. 2-5B illustrate a system, which may include or be a subsystem of one or more systems described herein (e.g., system 100, 600, 800, 900, and/or 1000). The system (e.g., system 100) illustrations include schematic diagrams of retainer and die 210 unfastened from a die plate 115 (see FIG. 2), retainer and die 210 inserted into a retainer receiving space 125 which may then be secured by a retainer fastener 215 (see FIG. 3), retainer and die 210 secured in a retainer receiving space 125 using a retainer fastener 215 (see FIG. 4), retainer and die 210 secured in a retainer receiving space 125 and mandrel 110 detached (see FIG. 5A), and retainer and die 210 secured in a retainer receiving space 125 and mandrel attached (see FIG. 5B). Illustrations may include a mandrel and casing in retainer and die 210.

Figure 2:
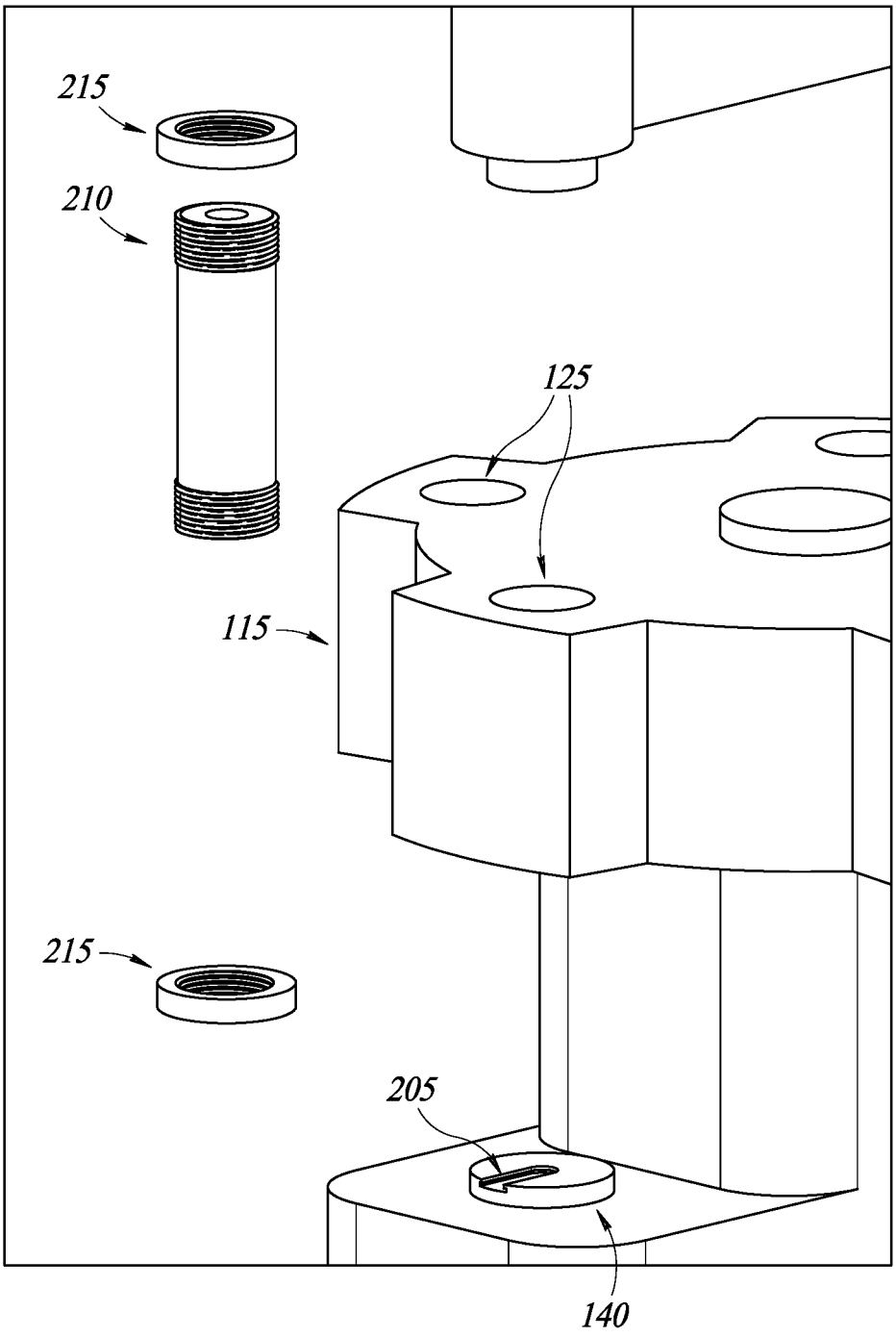
FIGS. 2-4, 5A, and 5B illustrate a schematic diagram for a system for modifying a projectile casing in more detail in accordance with at least one embodiment.

The schematic diagram in FIG. 2 includes an illustration of a retainer and die 210 unfastened from a die plate 115. As an example, retainer and die 210 includes the retainer with threading on outside ends, such that they may extend outside of the retainer receiving space 125 of the die plate 115 to be secured with a retainer fastener 215. A retainer fastener 215 includes a nut, and/or securing object with threading. A system (e.g., system 100) may use one or more fasteners 215 to secure the retainer and die 210. In at least one embodiment, the retainer and die 210 are of a length longer than a retainer receiving space 125 of the die plate 115, where the length of the retainer extended on both ends may include threading. To secure the retainer and die 210, it is positioned within the retainer receiving space 125 of the die plate 115 where then a retainer fastener 215 secures both ends. This process may be repeated for one or more retainer receiving spaces 125. The illustrated system may also include a receiving base 140 for a casing, which includes a means of securing a casing (e.g., securing groove 205). For example, the casing may include a securing groove 205, where a casing's extractor groove may slide into a groove with a decreasing width (as illustrated) until snug and securely aligned along the center of where the mandrel will be placed. The securing groove may also align with the retainer receiving space 125 of the die plate 115, though that may change if the die plate 115 is rotated along a pivotal connection.

Figure 3:
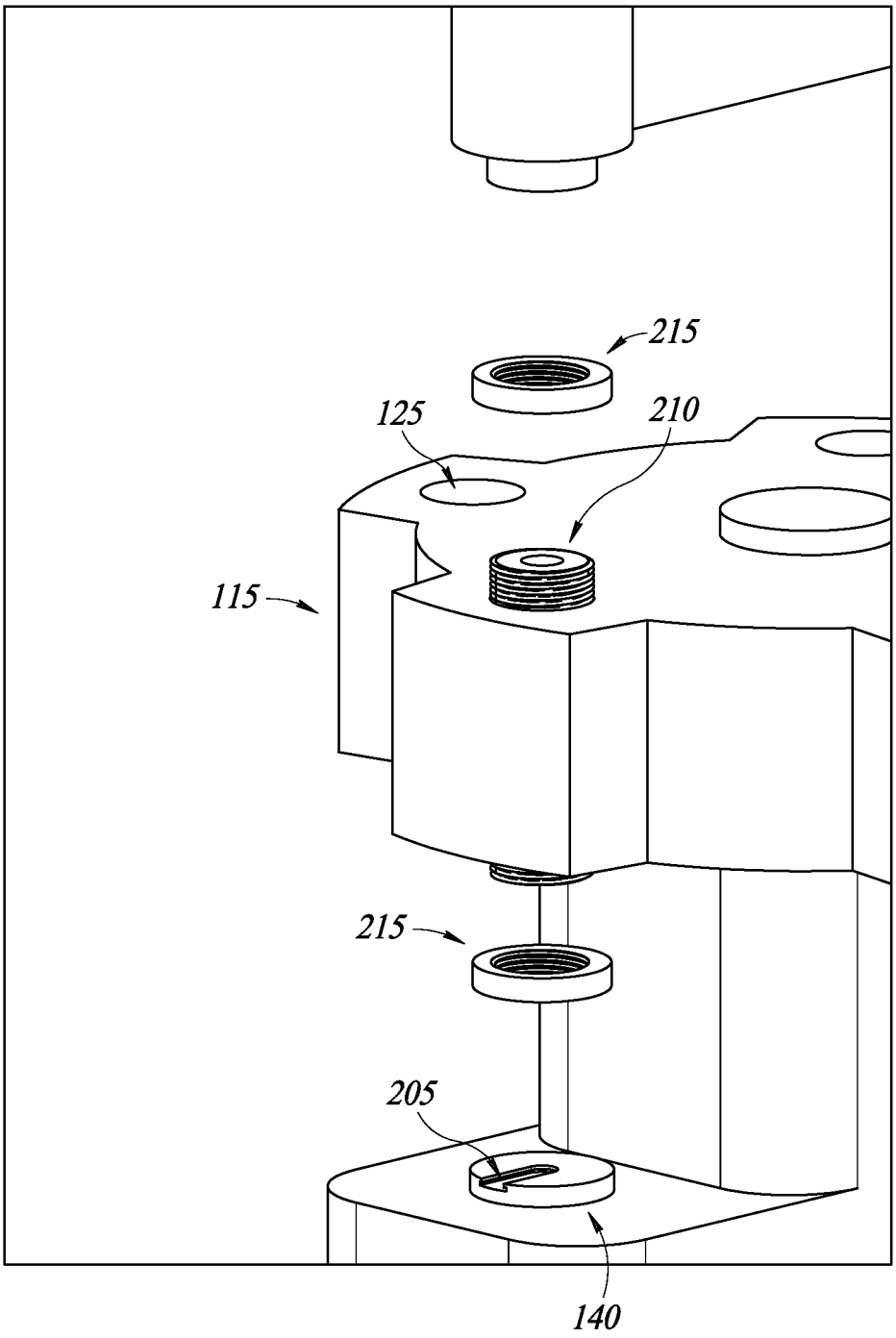

The schematic diagram in FIG. 3 includes an illustration of a retainer and die 210 inserted into a retainer receiving space 125 of a die plate 115, which may then be secured by a retainer fastener 215 (e.g., nut). The nut (e.g., retainer fastener 215) secures the retainer and die 210 into the retainer receiving space 125 of die plate 115 using threading on the outside of the retainer and die 210 and interior of the nut (e.g., retainer fastener 215). If the die plate 115 is properly aligned, the retainer and die 210 and retainer receiving space 125 will align with the receiving base 140, where a casing will be centered if inserted into securing groove 205.

Figure 4:
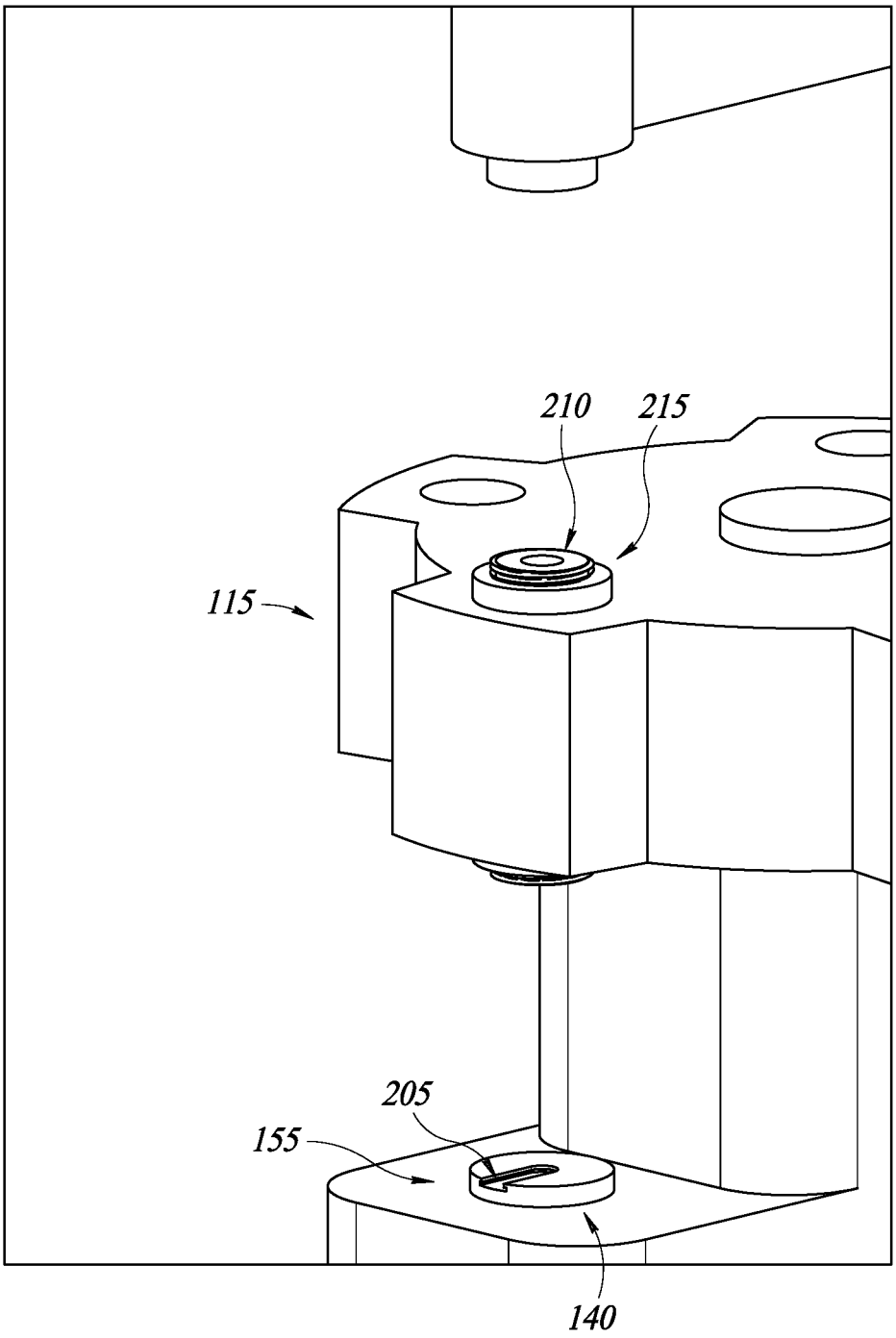

The schematic diagram in FIG. 4 includes an illustration of a retainer and die 210 secured in a retainer receiving space 125 of the die plate 115 using a retainer fastener 215 (e.g., nut). The receiving base 140 with a securing groove 205 is aligned with retainer and die 210 secured into the die plate 115. As an example, the receiving base 140 may be secured or part of a hydraulic cylinder 155 to position a projectile into a retainer and die 210, such as to be shaped by a mandrel and die.

Figure 5A:
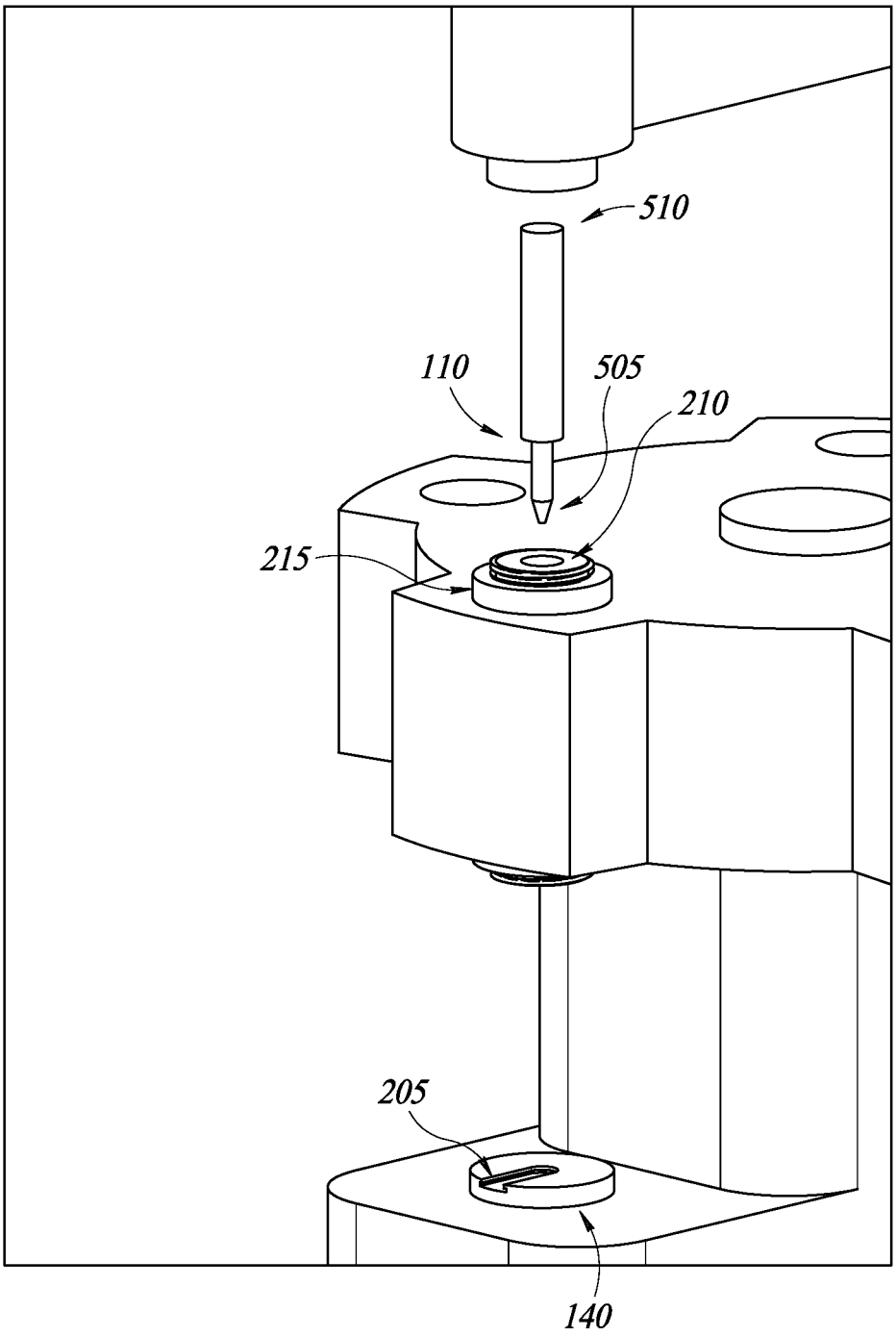

The schematic diagram in FIG. 5A includes an illustration of a retainer and die 210 secured in a retainer receiving space 125 and mandrel 110 detached. The mandrel 110 includes a mandrel end 505 and mandrel rod 510. The mandrel 110, mandrel end 505, and/or mandrel rod 510 are further illustrated in FIGS. 15A-16F. A mandrel 110 end includes an end 505 which is designed to modify a projectile. A mandrel rod 510 may attach (e.g., secure) to the system body, such as through rotation, threading, pressure, and/or friction to the hydraulic cylinder 145 to position mandrel 110. A mandrel rod 510 may include a securing end and a projectile modification end 505. The mandrel 110 may align with retainer and die 210, one or more retainer fasteners 215, and/or a receiving base 140 with a securing groove 205 for a projectile (e.g., also to be aligned with a mandrel 110 when connected to the system).

Figure 5B:
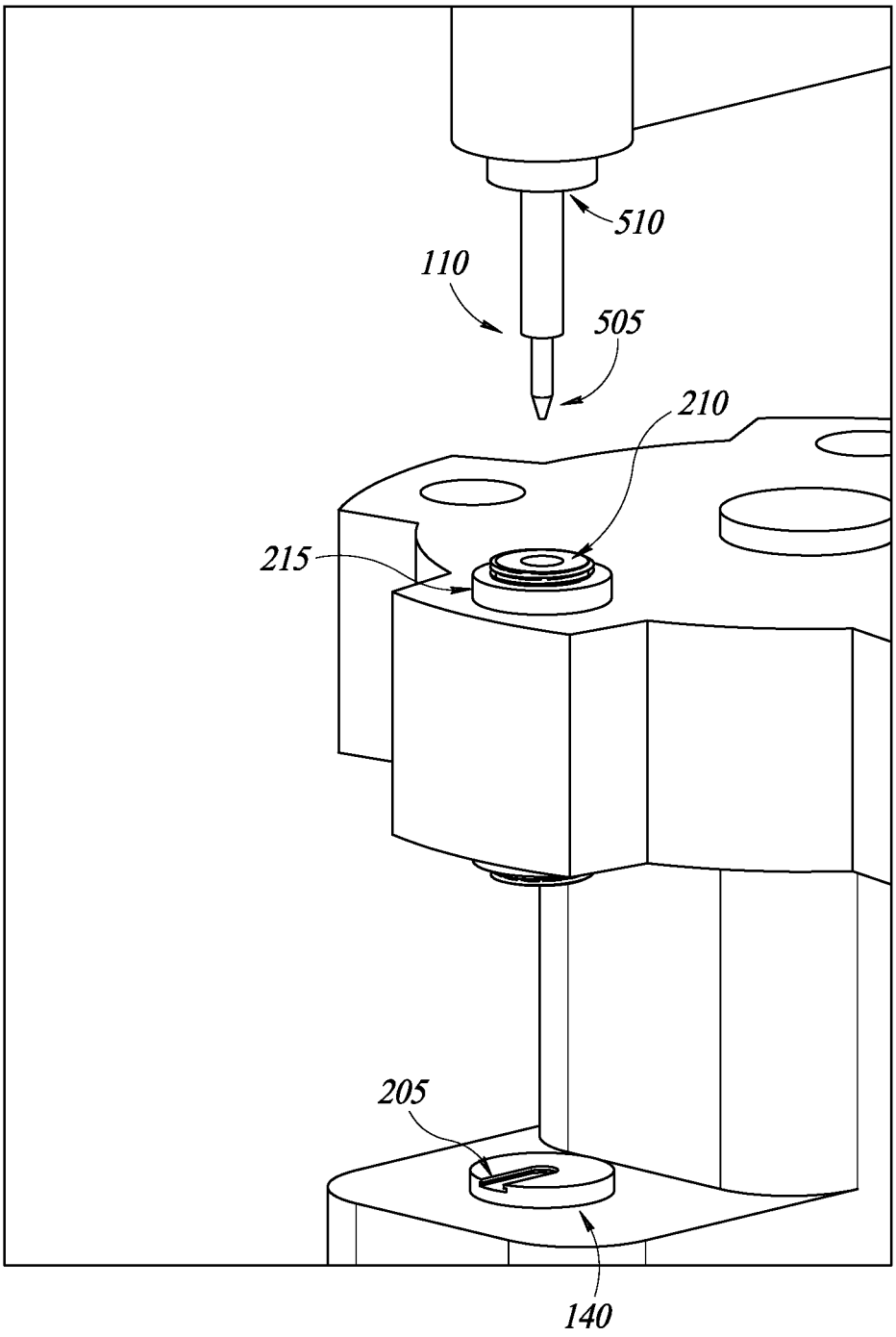

The schematic diagram in FIG. 5B includes an illustration of a retainer and die 210 secured in a retainer receiving space 125 and mandrel 110 attached. The illustration includes a mandrel rod 510 attached (e.g., secure) to the system body, such as through rotation, threading, pressure, and/or friction to the hydraulic cylinder 145 to position mandrel 110. A mandrel rod 510 may include a securing end and a projectile modification end 505. The mandrel 110 illustrated aligns with retainer and die 210, one or more retainer fasteners 215, and/or a receiving base 140 with a securing groove 205 for a projectile (e.g., also to be aligned with a mandrel 110 when connected to the system).

Figure 6:
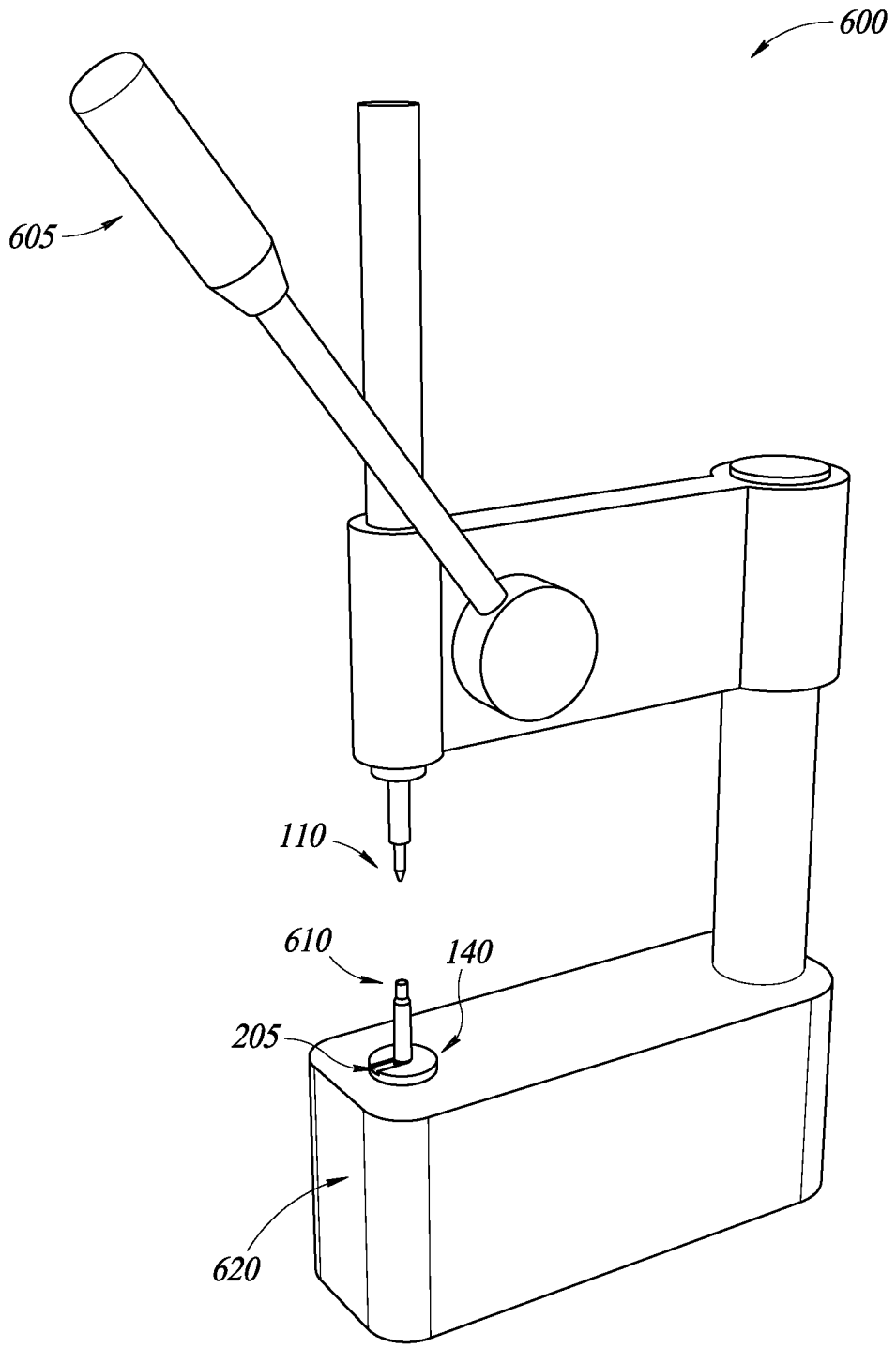
FIG. 6 illustrates another schematic diagram for a system to modify a projectile casing in accordance with at least one embodiment.

FIG. 6 illustrates another schematic diagram for a system 600 to modify a projectile casing in accordance with at least one embodiment. FIG. 6 illustrate a system 600, which may include and/or be a subsystem of one or more systems described herein (e.g., system 100, 800, 900, and/or 1000). In at least one embodiment, system 600 includes mandrel 110, receiving base 140, securing groove 205, lever 605, projectile casing 610 (e.g., casing 105), and/or base 620. The base 620 may include a receiving base 140, such that a projectile casing 610 may be secured, centered on a mandrel 110. A base 620 may house components to move a mandrel 110, such as electrical circuitry, hydraulics, clamps (e.g., loosened or tightened by a position of lever), and/or other components described herein. For example, the securing groove 205 connects to a projectile casing 610 at the casing's 610 extractor groove. In at least one embodiment, securing can include attaching, screwing, clipping, or otherwise fixing in a removable way a projectile casing on a support structure (e.g., platform, part of a machine for resizing and/or shaping casings). The securing groove 205 may end when a casing 610 is centered below the mandrel 110. In at least one embodiment, the receiving base 140 is attachable and detachable, such that a casing 610 size (e.g., caliber) may correspond to a receiving base 140. System 600 may use a lever, rotatably attached to a system 600 body (e.g., base 620). The lever 605, in at least one embodiment, releases the mandrel 110, lowering it manually (e.g., gravity, through spinning lever 605, or moving up/down on the lever sliding the cylinder attached to the mandrel 110 down), electrically powered to move the mandrel down where the lever 605 indicates a direction to move, and/or uses hydraulics based, at least in part, on an orientation of the lever 605. When a lever 605 is in a position indicating to a system 600 to move (e.g., using and/or assisted by gravity) a mandrel 110 into a die, a casing 610 may then be raised into a die where a mandrel 110 may then shape (e.g., modify) the neck of the casing 610 according to mandrel's 110 diameter, which may correspond to a size of a projectile (e.g., caliber). Once a projectile casing 610 is modified and/or confirmed to be of a preferred shape (e.g., used in self-loading for precision marksmanship), a lever may be changed to a position indicating to a system 600 to move a mandrel, such as to mechanically extract the mandrel 110 from the projectile (e.g., bullet) casing 610. In at least one embodiment, a projectile casing 610 is otherwise an object (e.g., metallic and/or plastic object to be modified with precision).

FIGS. 7A, 7B, 7C, 7D, 7E, and 7F illustrate a schematic diagram of a die and mandrel for modifying a projectile casing in accordance with at least one embodiment. In at least one embodiment, a system secures retainer and die based, at least in part, on using prongs. In at least one embodiment, a system (e.g., system 1405) is as otherwise illustrated in FIGS. 14A-14D. Prongs may be used for alignment of a die and mandrel, where a casing is centered and/or inserted parallel to the neck of a die, mandrel further modifying the casing by expanding it into the die. FIGS. 7A-7F include illustrations of a pronged resizing mandrel system disassembled (see FIGS. 7D-7F) and assembled (see FIGS. 7A-7C) according an outside perspective (see FIGS. 7A and 7D), face-view (see FIGS. 7B and 7E), and cross-sectional view (see FIGS. 7C and 7F).

Figure 7A:
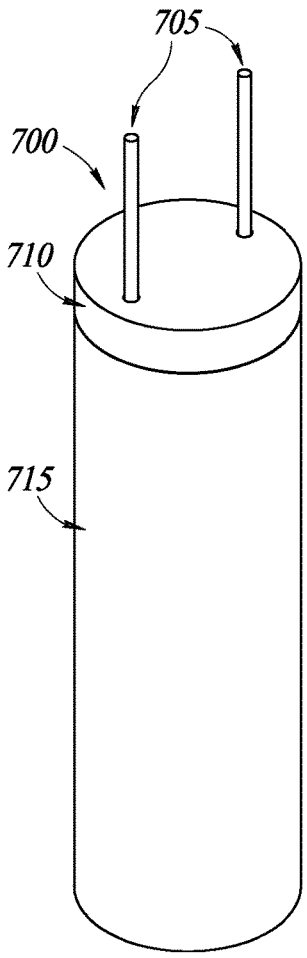
FIGS. 7A, 7B, 7C, 7D, 7E, and 7F illustrate a schematic diagram of a die and mandrel for modifying a projectile casing in accordance with at least one embodiment.

The schematic diagram in FIG. 7A includes an illustration of an assembled pronged resizing mandrel system. Visible from this view includes a resizing mandrel system 700, which may comprise prongs 705, mandrel base 710, and retainer 715. When inserted in this manner, if a cartridge casing and die are inside, this could shape (e.g., modify) a casing according to the die. As illustrated, prongs may secure a mandrel base 710 according to a horizontal axis, which may only allow vertical movement, such as to center a mandrel base 710 on a retainer 715, die, and/or casing. One or more prongs and/or other securing measures may be used. In at least one embodiment, the assembled pronged resizing mandrel system is otherwise illustrated in FIGS. 7B and 7C from alternative perspectives. As an example, components of the system are assembled by inserting a die into the retainer 715, inserting the mandrel 110 into the die and retainer 110, and then inserting the casing into the system. Then, once the casing is inserted, the mandrel may be extracted using the one or more prongs 705. One or more systems described herein (e.g., system 100 and/or system 600) may be used in connection with the assembled pronged resizing mandrel system 700, such as to modify a casing.

Figure 7B:
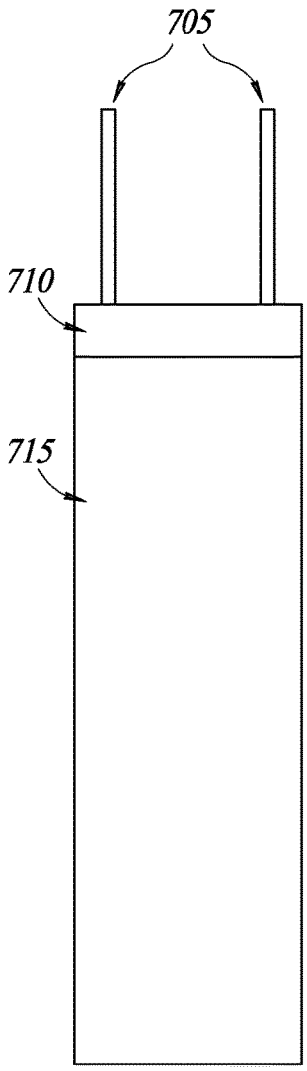

The schematic diagram in FIG. 7B includes an illustration of a front view for an assembled pronged resizing mandrel system 700. Visible from this view includes a resizing mandrel system 700, which may comprise prongs 705, mandrel base 710, and retainer 715. Prongs 705 are inserted through mandrel base 710 and retainer 715. Prongs 705 may align mandrel 710 centered on retainer 715 and die, inserted parallel to vertical axis of casing to shape casing neck. In at least one embodiment, the assembled pronged resizing mandrel system 700 is otherwise illustrated in FIGS. 7A and 7C from alternative perspectives.

Figure 7C:
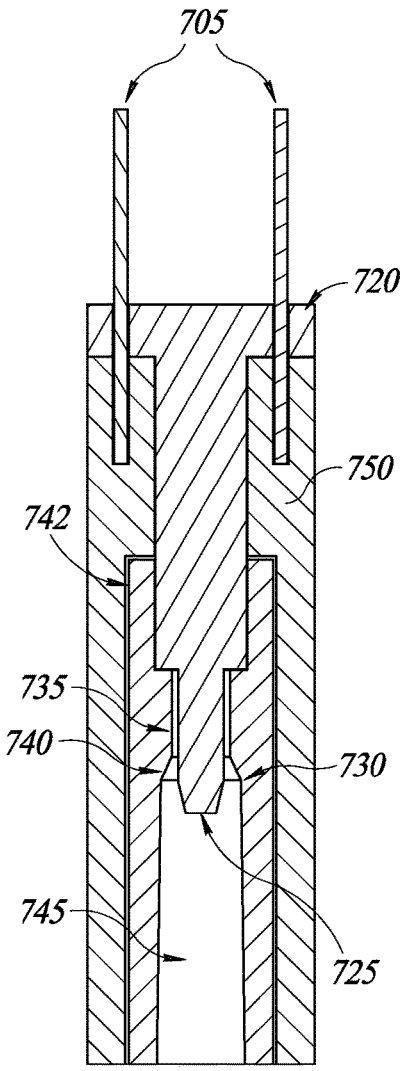

The schematic diagram in FIG. 7C includes an illustration of a cross-sectional view for an assembled pronged resizing mandrel system 720. Visible from this view includes a resizing mandrel system 720, which may comprise prongs 705, mandrel end 725, casing 730, casing neck 735, casing shoulders 740, die 742, casing chamber 745, and/or retainer 750. Prongs 705 align mandrel and mandrel end 725 along the vertical axis of the die 742 and retainer 750 and the mandrel is inserted. Then a casing 730 may be inserted into the casing chamber 745, such that the casing neck 735 and casing shoulders 740 are shaped evenly by the mandrel expanding the casing into the die (e.g., or confirming that a casing 730 is of a desired shape). A casing 730 may include casing neck 735 and casing shoulders 740. The casing 730 may be housed in the casing chamber 745 inside the die 742. The die 742 may be housed within the retainer 750, which can be secured in the retainer 750 using friction, a base, threading, adhesive, other securing means described herein or combinations thereof. In at least one embodiment, the assembled pronged resizing mandrel system 720 is otherwise illustrated in FIGS. 7A and 7B from alternative perspectives.

Figure 7D:
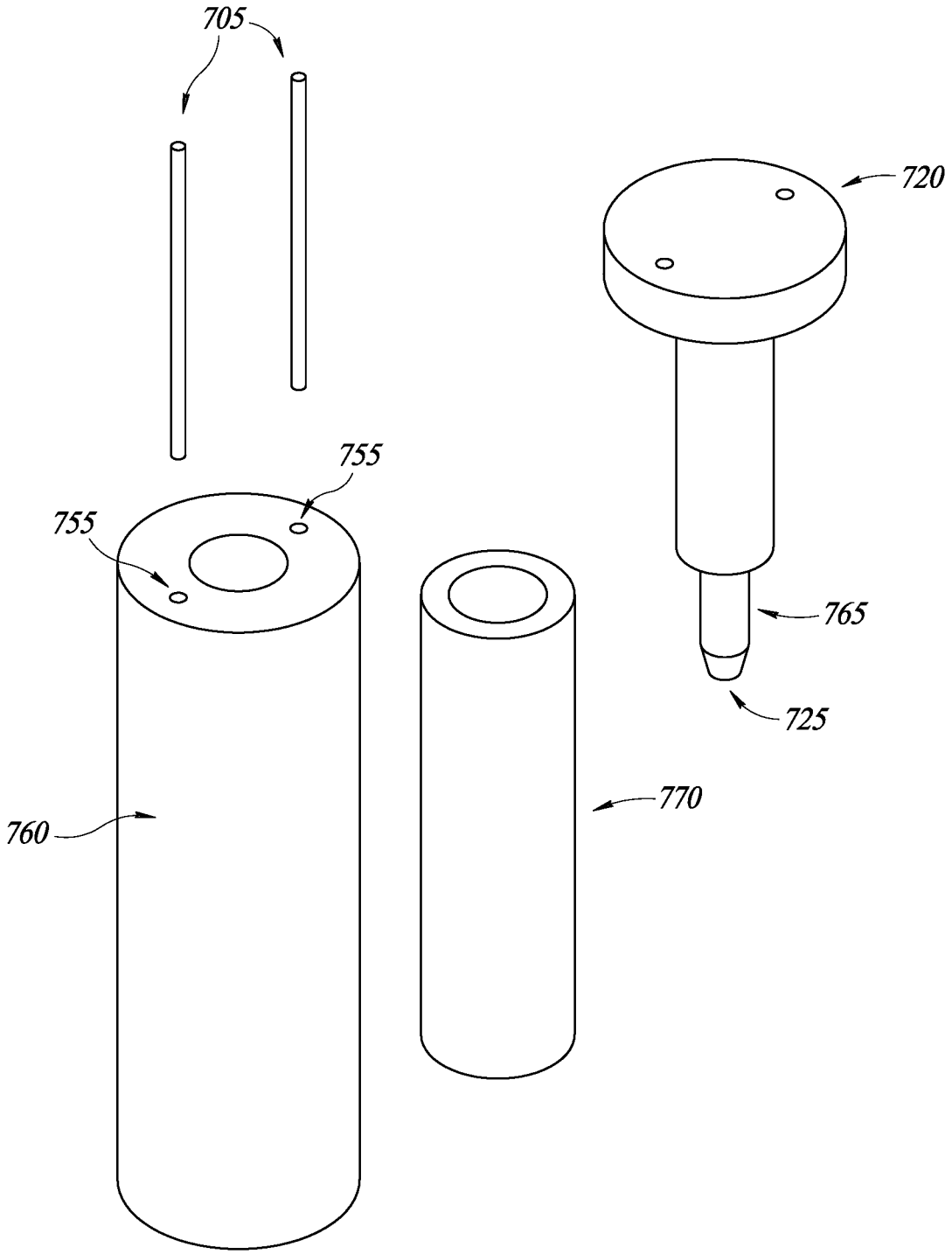

The schematic diagram in FIG. 7D includes an illustration of a disassembled pronged resizing mandrel system 720. Visible from this view includes a resizing mandrel system 720, which may comprise prongs 705, retainer 715, mandrel end 725, prong holes 755, mandrel rod 765, and/or die 770. In at least one embodiment, the disassembled pronged resizing mandrel system 720 is otherwise illustrated in FIGS. 7E and 7F from alternative perspectives.

Figure 7E:
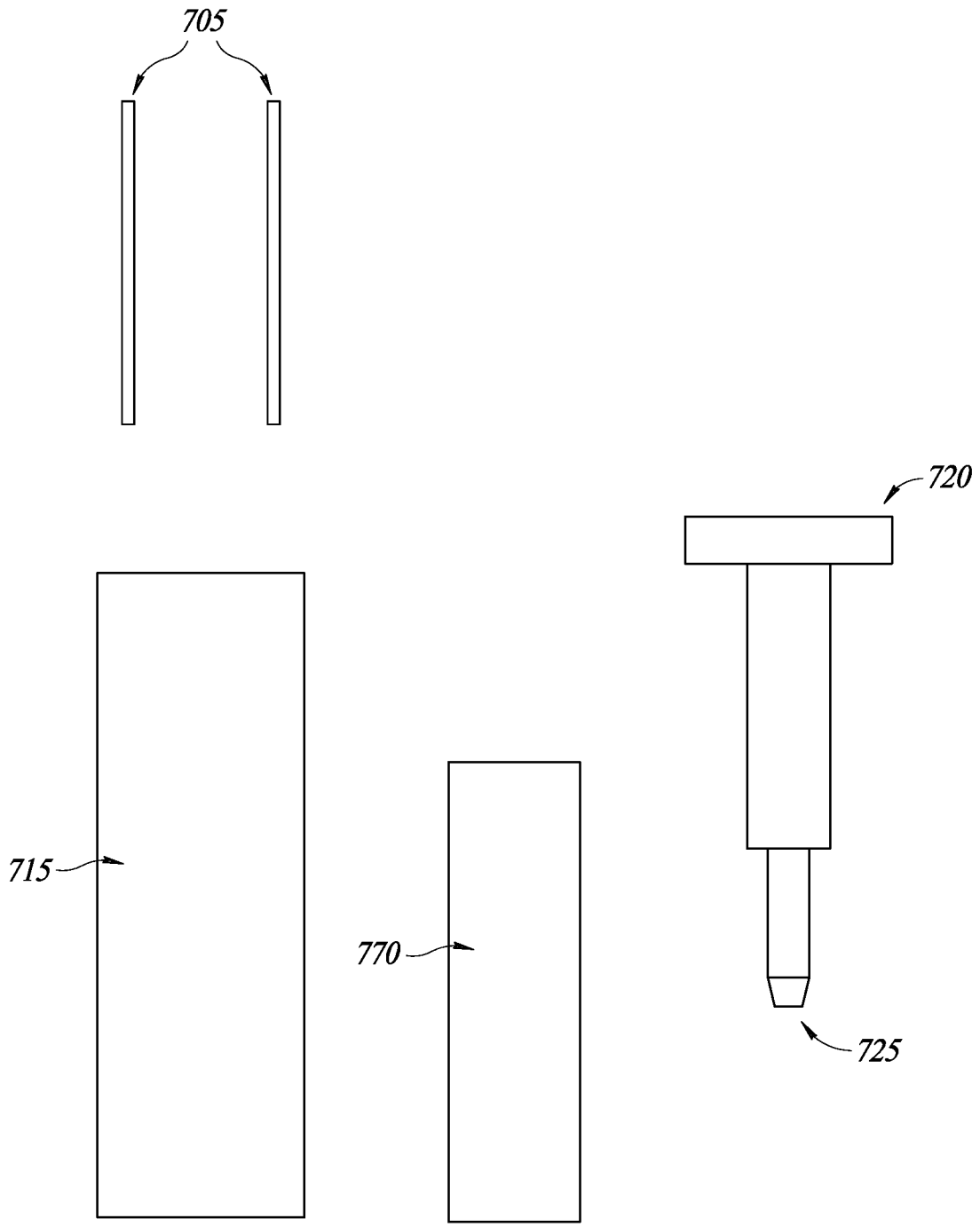

The schematic diagram in FIG. 7E includes an illustration of a front view for a disassembled pronged resizing mandrel system. Visible from this view includes a resizing mandrel system 720, which may comprise prongs 705, retainer 760, mandrel end 725, prong holes 755, mandrel rod 765, and/or die 770. In at least one embodiment, the disassembled pronged resizing mandrel system 720 is otherwise illustrated in FIGS. 7D and 7F from alternative perspectives.

Figure 7F:
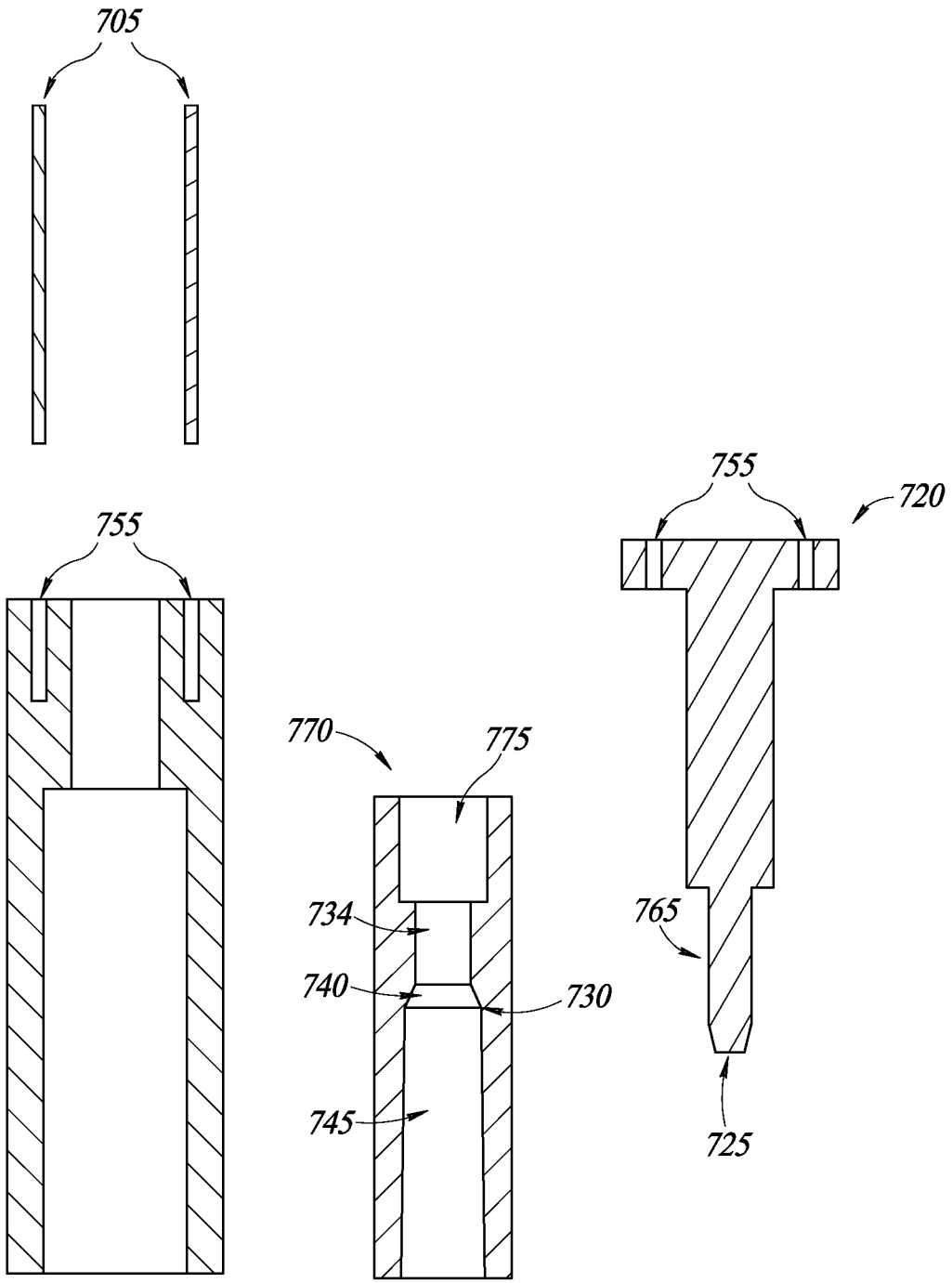

The schematic diagram in FIG. 7F includes an illustration of a cross-sectional view for a disassembled pronged resizing mandrel system. Visible from this view includes a resizing mandrel system 720, which may comprise prongs 705, mandrel end 725, casing 730, casing neck 734, casing shoulders 740, casing chamber 745, prong holes 755, mandrel rod 765, and/or mandrel chamber 775. Resizing die 770 system may include mandrel chamber 775, casing 730, casing neck 734, casing shoulders 740, and/or casing chamber 745. Prongs 705 may enter through the prong holes 755

(such as to guide a mandrel) and enter into a recess in the retainer 760, prong holes 755 of the retainer 760. In at least one embodiment, the order in which prongs 705 align a mandrel rod 765 with a retainer 760 and die 770 may vary, such as by the prongs 705 being first inserted into a retainer 760 and then a mandrel rod 765 aligns with the retainer 760, aligning with the prongs 705 to be inserted. In an example, prongs 705 may be attached to mandrel rod 765 and then align prongs 705 to be inserted into the prong holes 755 of the retainer 760. In at least one embodiment, the disassembled pronged resizing mandrel system 720 is otherwise illustrated in FIGS. 7D and 7E from alternative perspectives.

Figure 8A:
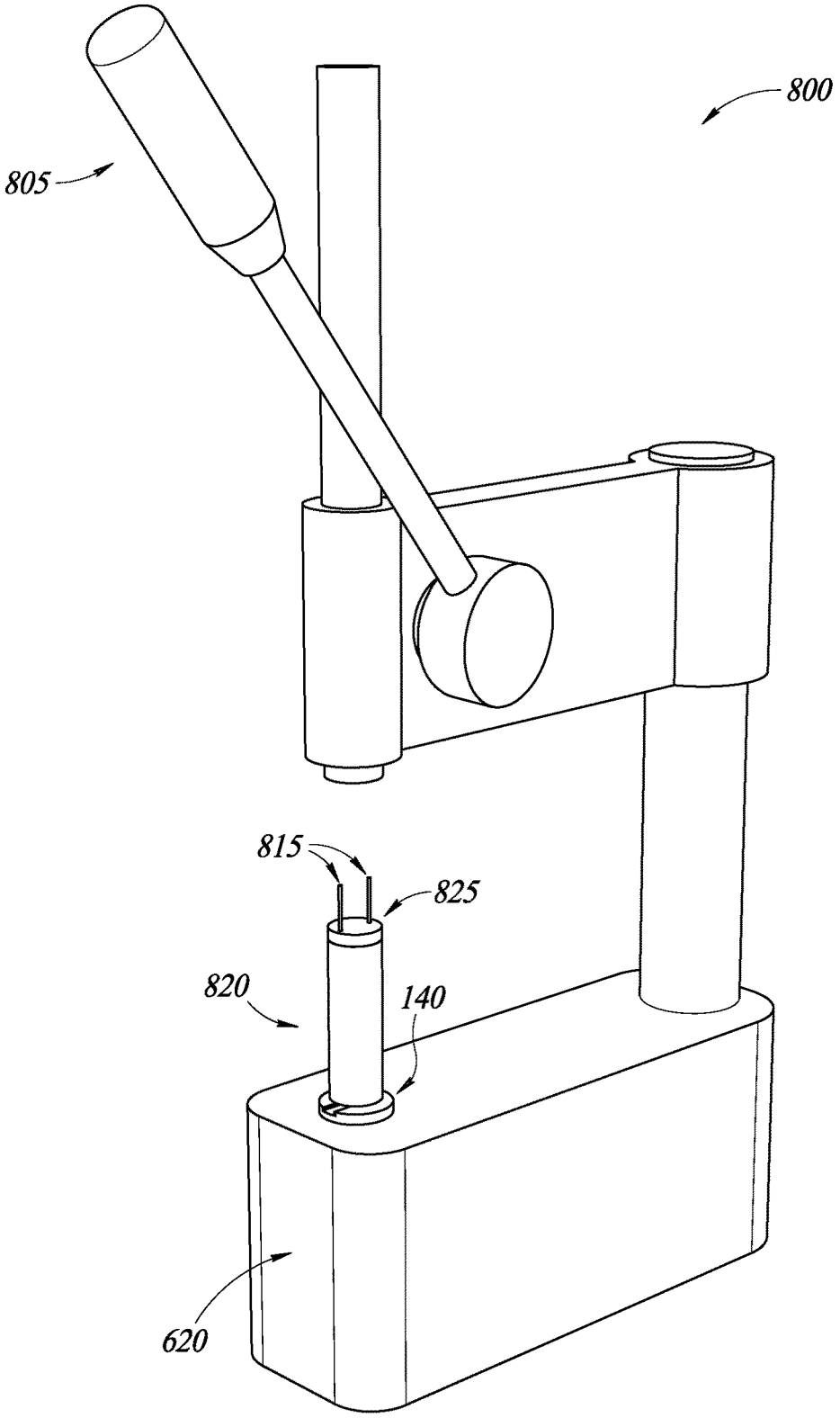
FIGS. 8A and 8B illustrate another schematic diagram for a system to modify a projectile casing in accordance with at least one embodiment.
Figure 8B:
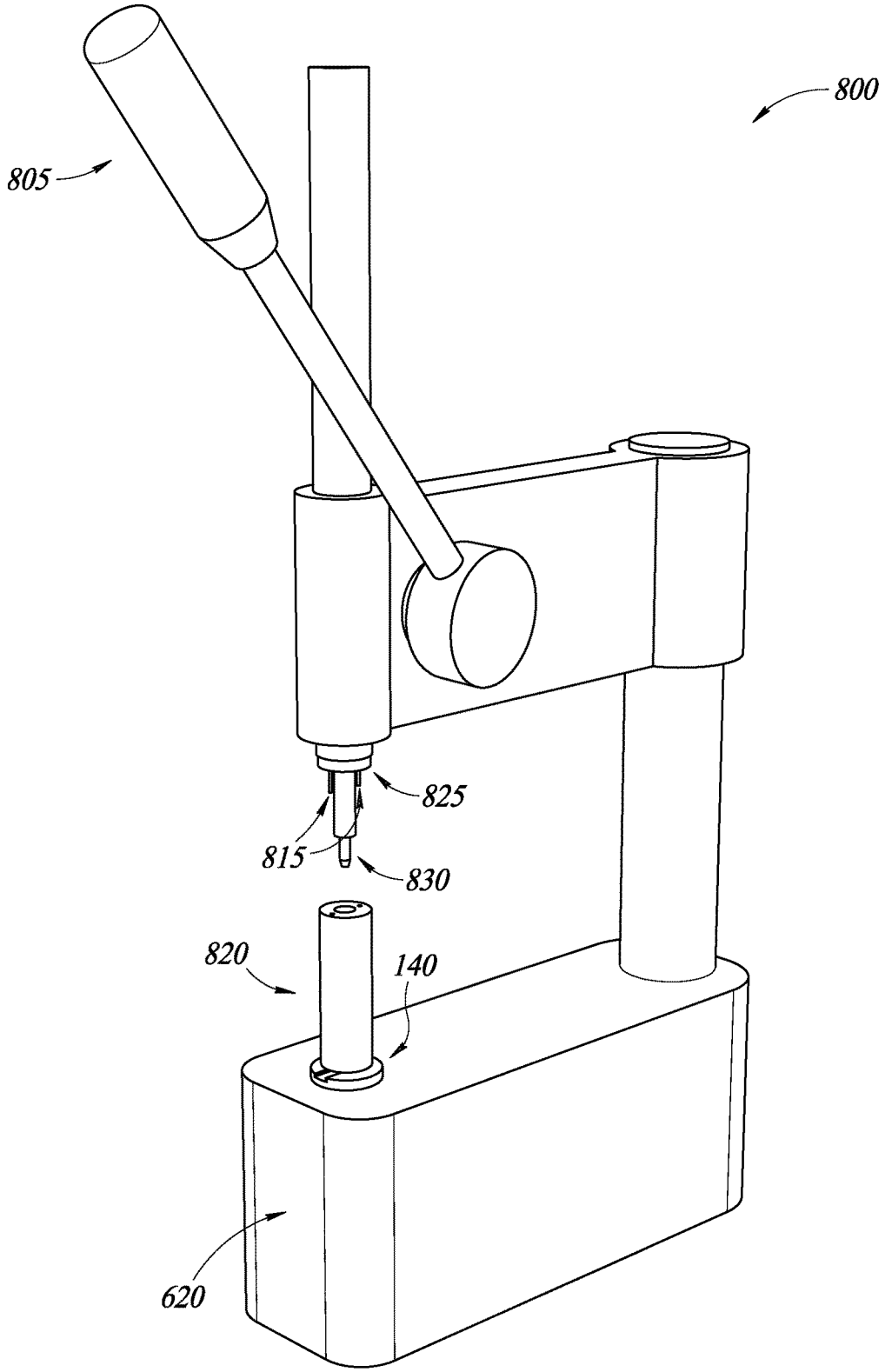

FIGS. 8A and 8B illustrate another schematic diagram for a system 800 to modify a projectile casing in accordance with at least one embodiment. FIGS. 8A and B illustrate a system 800, which may include or be a subsystem of one or more systems described herein (e.g., system 100, 600, 900, and/or 1000). In at least one embodiment, a system 800 modifies a casing based, at least in part, on a mandrel guided by prongs. System 800 is illustrated as mandrel attached (see FIG. 8A) and detached (see FIG. 8B) from casing, retainer, and die system 820. For example, the mandrel may first be inserted into the die and retainer for a process (e.g., process illustrated in FIG. 21). Then a casing may be inserted manually into the retainer and die, being expanded into the die by using the previously inserted mandrel. Then the retainer housing the die, mandrel, and casing (e.g., casing, retainer, and die system 820) is attached to the receiving base 140, where then once secured the mandrel may be extracted.

The schematic diagram in FIG. 8A includes an illustration of an assembled pronged resizing mandrel system (as illustrated in FIGS. 7A-7C) for use by a casing reshaping system 800. A system 800 may include a receiving base 140; base 620; lever 805; prongs 815; casing, retainer, and die system 820; and/or resizing mandrel system 825. Assembled pronged resizing mandrel system (e.g., casing, retainer, and die system 820) may have a retainer attached to a receiving base 140, where receiving base 140 may further connect to a base 620. A lever 805 may include a lever 605. Inserting the mandrel into the die may include actuating a lever 805, activating a hydraulic system (e.g., system 100), activating an electrical system that moves a level and/or performing operations described herein. Furthermore, a casing may be inserted into a die, which includes a shaping mandrel, by actuating a lever 805, activating a hydraulic system (e.g., system 100), activating an electrical system that moves a level and/or performing operations described herein. Prongs 815 may attach to above cylinder, being secured such that the mandrel may be extracted away from the retainer, die, and casing. In at least one embodiment, the casing reshaping system 800 is otherwise illustrated in FIG. 8B where mandrel is extracted using prongs 815.

The schematic diagram in FIG. 8B includes an illustration of casing reshaping system 800 with mandrel is extracted. A system 800 may include a receiving base 140; base 620; lever 805; prongs 815; casing, retainer, and die system 820; resizing mandrel system 825; and/or mandrel end 830. Casing, retainer, and die system 820 may have the retainer attached to receiving base 140, where receiving base 140 may further connect to a base 620. A lever 805 may include a lever 605. Prongs 815 may attach to above cylinder, being secured such that the mandrel may move towards and away from the casing, retainer, and die system 820. In at least one embodiment, the casing reshaping system 800 is otherwise illustrated in FIG. 8A where mandrel is assembled to casing, retainer, and die system 820.

Figure 9A:
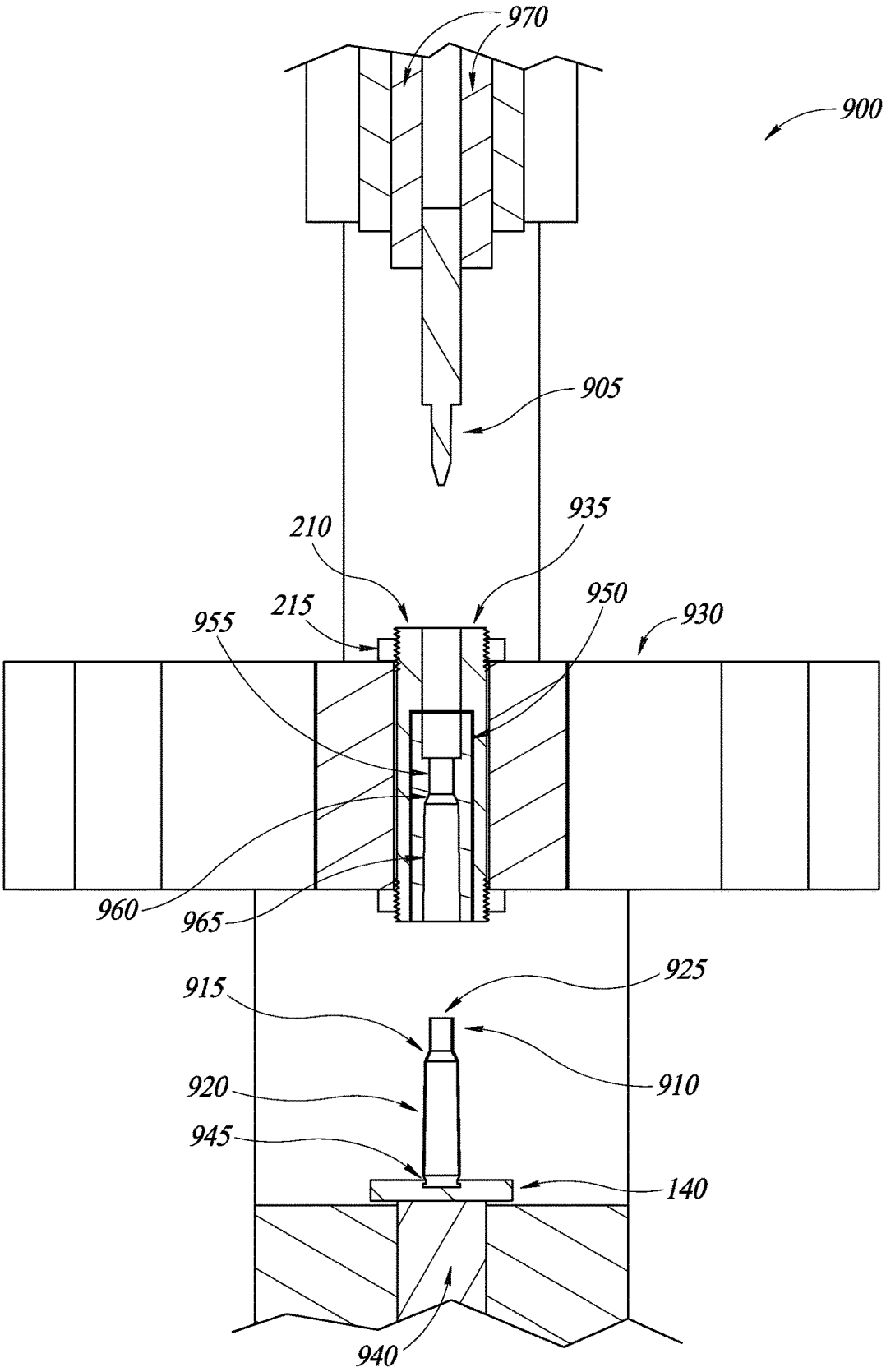
FIGS. 9A, 9B, 9C, 9D, 9E, and 9F illustrate schematic, cross-sectional views of a diagram for a system to modify a projectile casing in accordance with at least one embodiment.

FIGS. 9A, 9B, 9C, 9D, 9E, and 9F illustrate schematic, cross-sectional views of a diagram for a system 900 to modify a projectile casing in accordance with at least one embodiment. FIGS. 9A-9F illustrate a system 900, which may include or be a subsystem of one or more systems described herein (e.g., system 100, 600, 800, and/or 1000). System 900 may include system 100 to modify a casing, illustrating a cross-sectional view. FIGS. 9A-9F may illustrate the progressing steps for a process which may be performed by a projectile casing modification system 900. As an example, FIG. 9A illustrates a mandrel 905 raised by a mandrel 905 positioning cylinder 970 and loading of a casing into a case positioning cylinder 940. Casing may be received by a receiving base 140, such that a casing head is attached to the receiving base 140 (e.g., case head sliding into a groove). In the beginning position, casing is aligned with a retainer and die 210 of a preferred shape (e.g., caliber, casing length to accommodate the power charge). Mandrel 905 is positioned directly above die plate 930, aligning with retainer and die 210. As an example, a pivotal die plate 930 would also be rotated, if needed, to align the retainer and die 210 with a receiving base 140. System 900 may include receiving base 140, retainer and die 210, retainer fastener 215, mandrel 905, casing (e.g., comprising case neck 910, case shoulders 915, case body 920, and/or case opening 925), die plate 930, retainer 935, case positioning cylinder 940, case head 945, case shaping portion set 950 (e.g., comprising case neck shaping die portion, case shoulder shaping die portion 960, case body shaping die portion), mandrel positioning cylinder 970, or combinations thereof. System 900 is further illustrated in FIGS. 9B-9E.

Figure 9B:
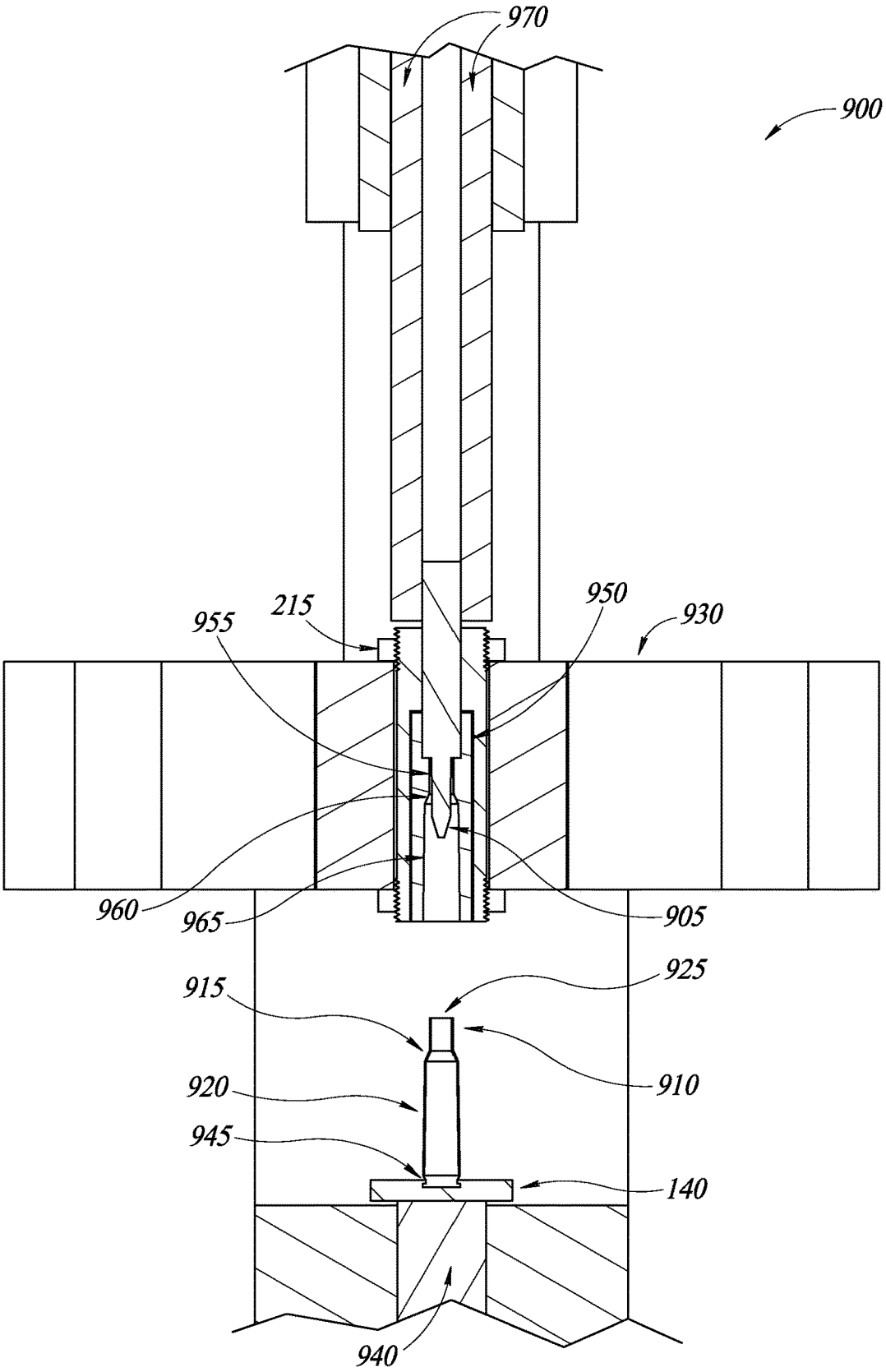

As an example, FIG. 9B illustrates inserting a mandrel 905, via a mandrel positioning cylinder 970, into a retainer and die 210. The mandrel 905 may be received by the retainer and die 210, such that it is inserted into a chamber of the die (e.g., the neck shaping portion), as illustrated non-exclusively in FIGS. 10A-10E. The mandrel 905 is narrower in diameter than the die diameter, such that a casing may slide between the mandrel and die, modifying the casing by expanding it outwards.

Figure 9C:
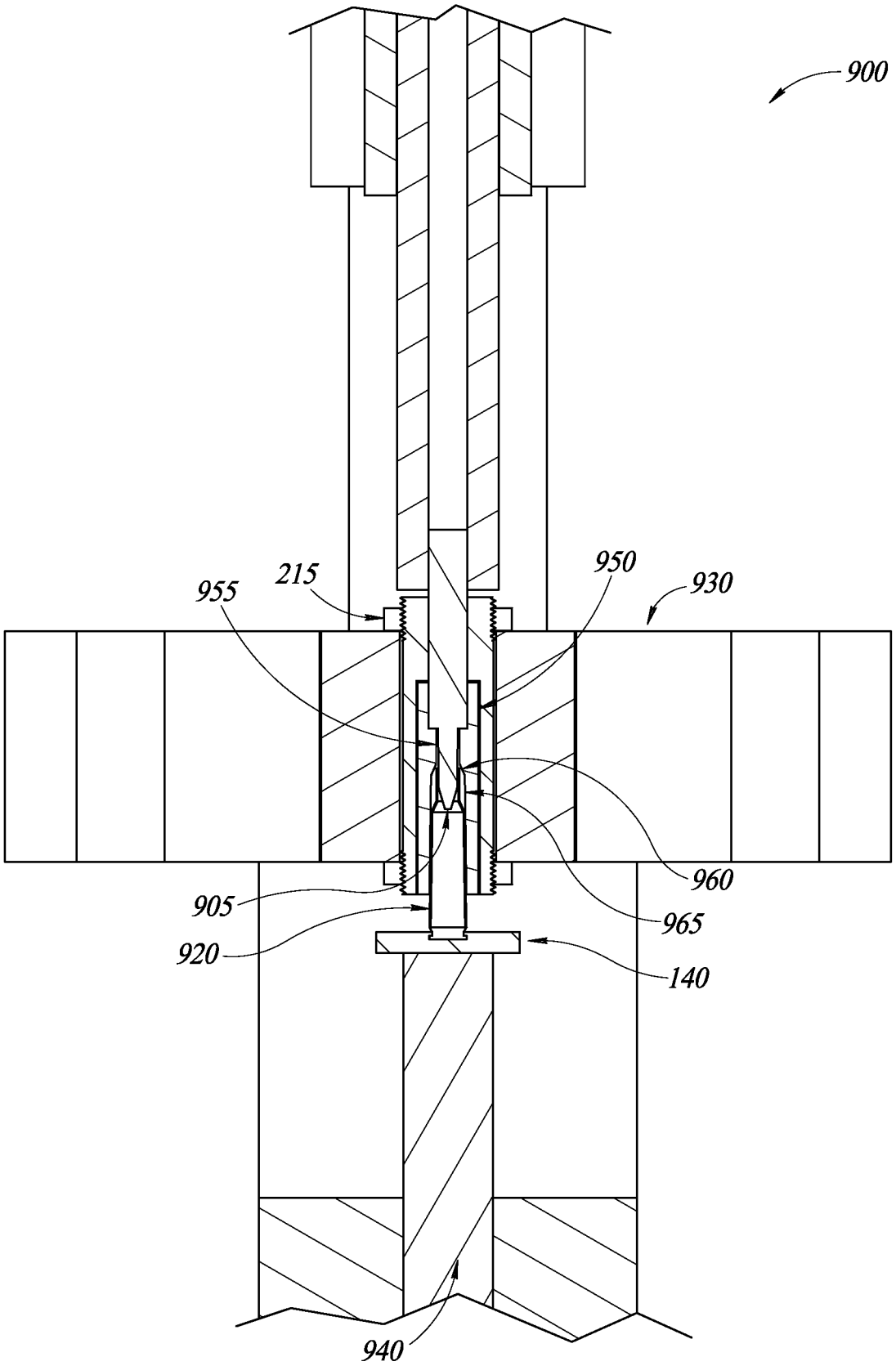

As an example, FIG. 9C illustrates raising a casing, via a case positioning cylinder 940, partially into the retainer and die 210. The case body 920 may be received by a case shaping portion set 950, as illustrated non-exclusively in FIGS. 13A-13D. The case body 920 may partially be inserted into the retainer and die 210, which may assist alignment of casing neck with a mandrel 905 housed (e.g., above) in the die.

Figure 9D:
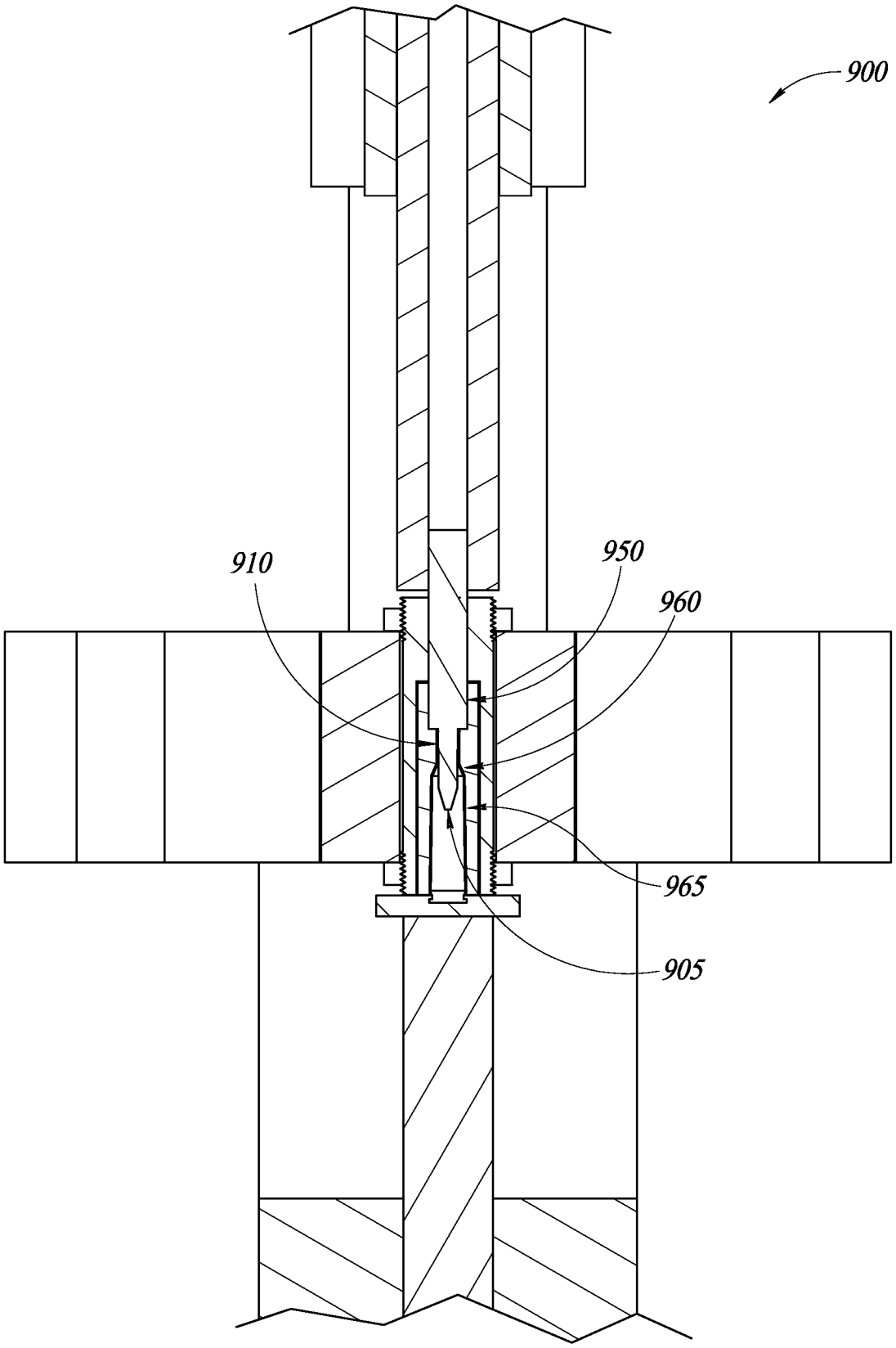

As an example, FIG. 9D illustrates raising a casing, via a case positioning cylinder 940, fully into the retainer and die 210, being shaped by a mandrel 905. Casing may then be fully inserted into retainer and die 210 the remaining distance, where the case shaping portion set 950 (e.g., case neck shaping die portion 955, case shoulder shaping die portion 960, and case body shaping die portion 965) may act as a guide and/or compress brass between the mandrel and the die into its desired shape (e.g., desired casing 1710, 1810, 1910, and/or 2010), as a mandrel 905 causes the brass to expand outwards into the die. FIG. 9D illustrates that a base, which is securing the projectile casing, is holding, securing, keeping, or otherwise maintaining the projectile casing in a raised position before the mandrel is extract from the die. FIG. 9D illustrates that the projectile casing is fully inserted into the die (e.g., it cannot be pushed any further into the die as it fits snuggly, the base is raised all the way up to a maximum height, the base is flush with the bottom of the support structure).

Figure 9E:
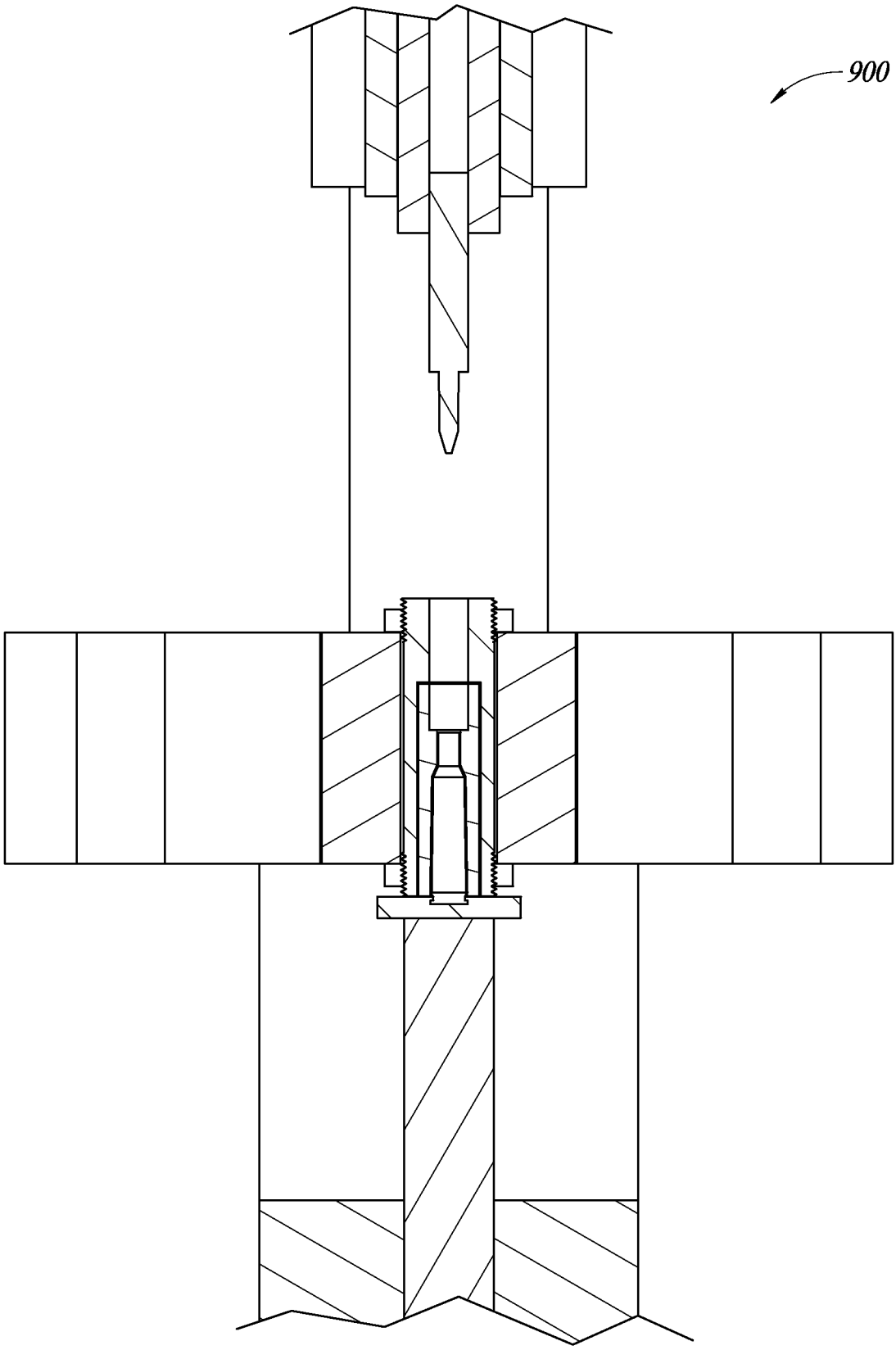

The schematic diagram in FIG. 9E includes an illustration of extracting a mandrel 905. Mandrel 905 expanded the casing into the die, which may construct a desired casing (e.g., desired casing 1710, 1810,1910, and/or 2010). Mandrel 905 may then be extracted away from the case body 920. Extracting mandrel 905 prior to an extraction of the casing may assist in retaining the shape of the casing molded by the die. In some cases, extraction of the casing prior to the mandrel can modify a casing from what it was shaped to in a die (e.g., introduce uneven brass distribution or angles into the casing). FIG. 9E illustrates that a base, which is securing (e.g., attaching, holding) the projectile casing, is holding, securing, keeping, or otherwise maintaining the projectile casing in a raised position while the mandrel is extract from the die, e.g., until the mandrel is completely extracted from the die (e.g., fully extracted such that no part of the mandrel is inside the die). FIG. 9E illustrates that the projectile casing is fully inserted into the die (e.g., it cannot be pushed any further into the die as it fits snuggly, the base is raised all the way up to a maximum height, the base is flush with the bottom of the support structure) as the mandrel is extracted. In at least one embodiment, because the projectile casing is held in place while the mandrel is extracted and the base is holding the projectile casing in the die (while the mandrel is being extracted), the mandrel is exerting pressure on the neck, shoulder, and body of the projectile casing through friction and pressure forces that causes the projectile casing neck, shoulder, and/or body to be shaped according to the interior shape of the die (e.g., the walls of the die on its interior). In at least one embodiment, because the mandrel is being extracted while the projectile casing is held in place pressure, friction, and other forces are applied in a uniform and secure manner such that the projectile casing is shaped in a uniform and secure way to reduce (e.g., remove) any defects and size (e.g., increase or decrease) dimensions of the projectile casing to a desired size (e.g., based on the interior of the die). In at least one embodiment, holding the base in a position while the mandrel is extracted from the die includes holding the base such that projectile casing is prevented from moving in any direction while the mandrel is extracted. For example, the while the mandrel is extracted, the base holds the projectile in position such that the projectile casing cannot wobble, move, spin, or otherwise modify its position.

Figure 9F:
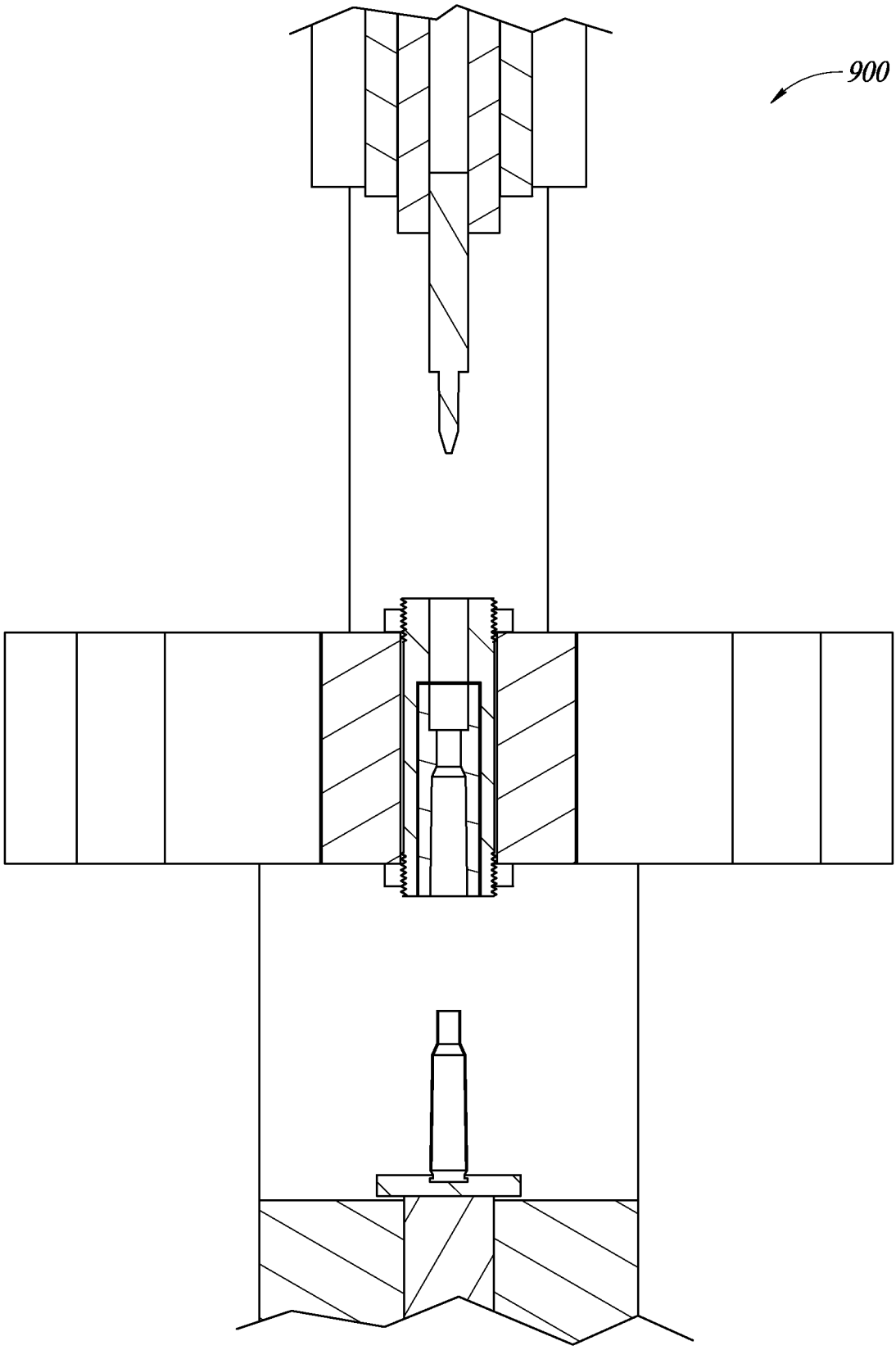

The schematic diagram in FIG. 9F includes an illustration of outputting a modified casing. Projectile casing modification system 900, illustrated through the progressive stages (though order may vary and/or be combined if desired), further illustrates system 100, but may include the addition of a die segmented into portions. For example, a die may be a single die or more than one die connected. A die may use threading to connect one or more die portions (e.g., portions 950, 955, 960, and/or 965), connecting into a case shaping portion set 950 (though a single die may also be used). As an example, a first die portion 965 may shape a case body 920, a second die portion 960 may shape a case shoulder 915, a third die portion 955 may shape a case neck 910, or combinations thereof. Retainer and die 210 may include a case shaping portion set 950. A die and/or portions of dies may shape a casing. A casing may connect to a receiving base 140 through a case head 945, where a case head 945 includes an extractor groove and rim. In at least one embodiment, a casing of a desired shape, formed by the die and mandrel, may have excess brass, such that the casing is too long where then the length of the casing's end may be cut (e.g., trimmed) and/or ground. Shaping of the casing using a mandrel and die may be repeated once the excess brass is removed.

FIGS. 10A, 10B, 10C, 10D, and 10E illustrate zoomed-in schematic diagram cross-sectional views for a system to modify a projectile casing in accordance with at least one embodiment. System 1000 may include system 100 to modify a casing, illustrating a cross-sectional view. FIGS. 10A-10E illustrate a system 1000, which may include or be a subsystem of one or more systems described herein (e.g., system 100, 600, 800, and/or 900). FIGS. 10A-10E may illustrate the progressing steps for a process (e.g., process illustrated in FIG. 21) which may be performed by a casing modification system 1000.

Figure 10A:
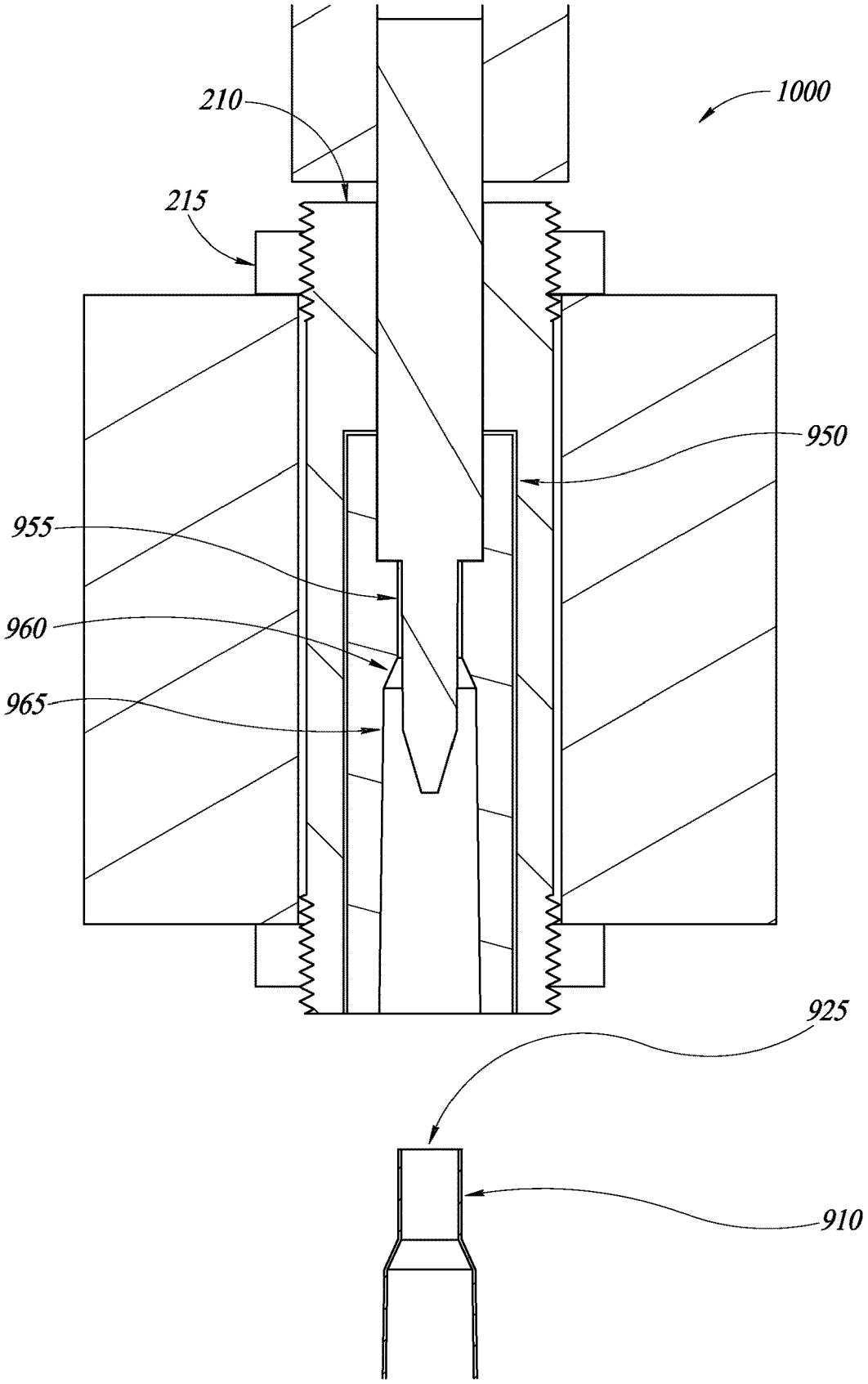
FIGS. 10A, 10B, 10C, 10D, and 10E illustrate zoomed-in schematic diagram cross-sectional views for a system to modify a projectile casing in accordance with at least one embodiment.

As an example, FIG. 10A includes illustrating a cross-sectional view of a mandrel being inserted into retainer and die 210. Also, a casing may be aligned with the mandrel, retainer, and die. As another example, a hydraulic cylinder may position the mandrel into the retainer and die 210. Retainer and die 210 are housed by a die plate.

Figure 10B:
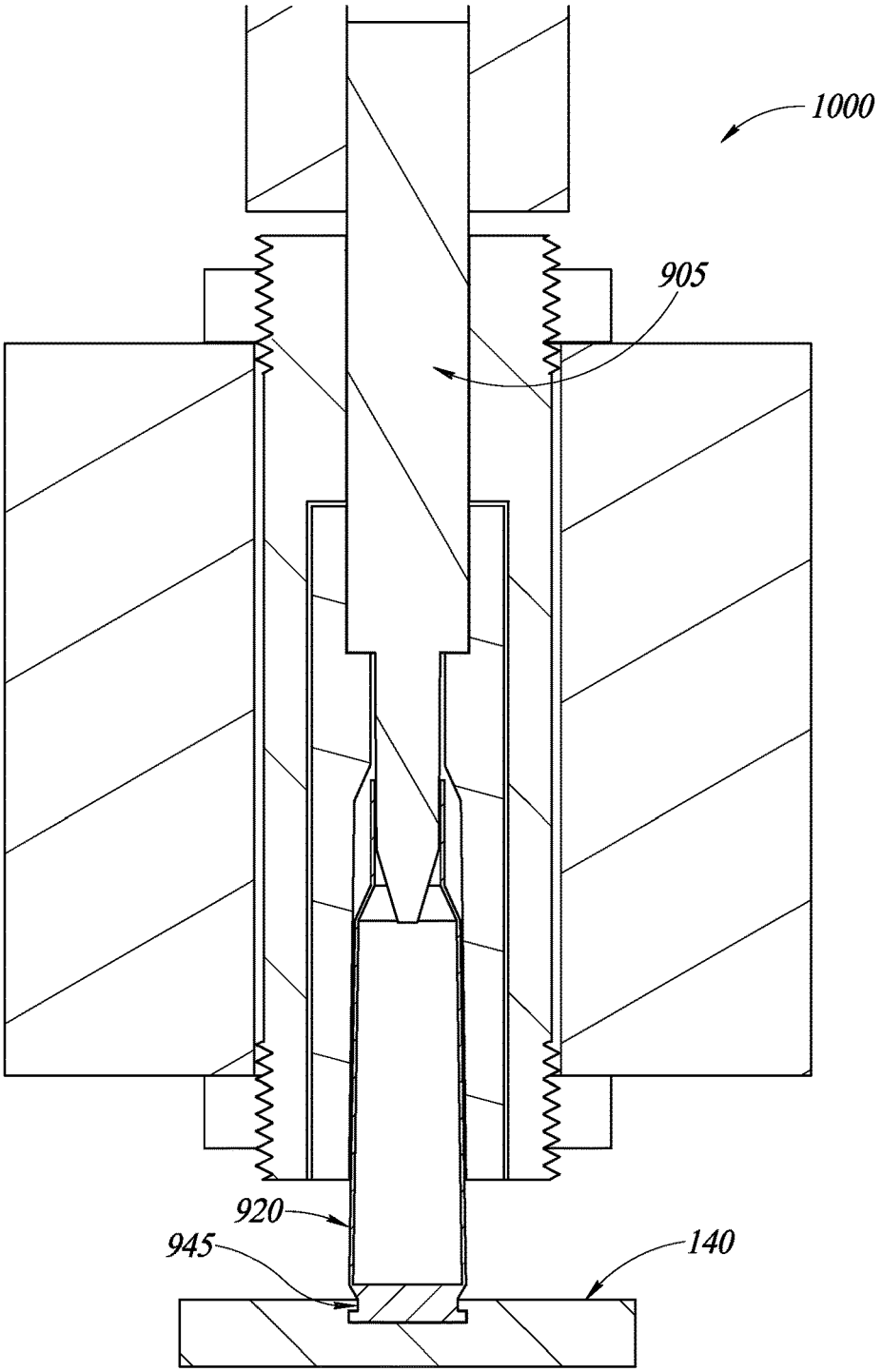

As an example, FIG. 10B includes illustrating a cross-sectional view of a casing partially inserted into retainer and die 210, being modified by mandrel 905. Partial insertion of the casing, prior to complete insertion, may assist correct placement of the case neck 910 into the retainer and die 210. As an example, to partially insert the case body, the receiving base 140 applies a constant amount of pressure until the casing is inserted partially, stopping before the neck 910 enters the case neck 910 shaping die portion 955. In this example, a mandrel 905 expands the casing neck. This may follow with full insertion of the casing, as illustrated in FIG. 10C.

Figure 10C:
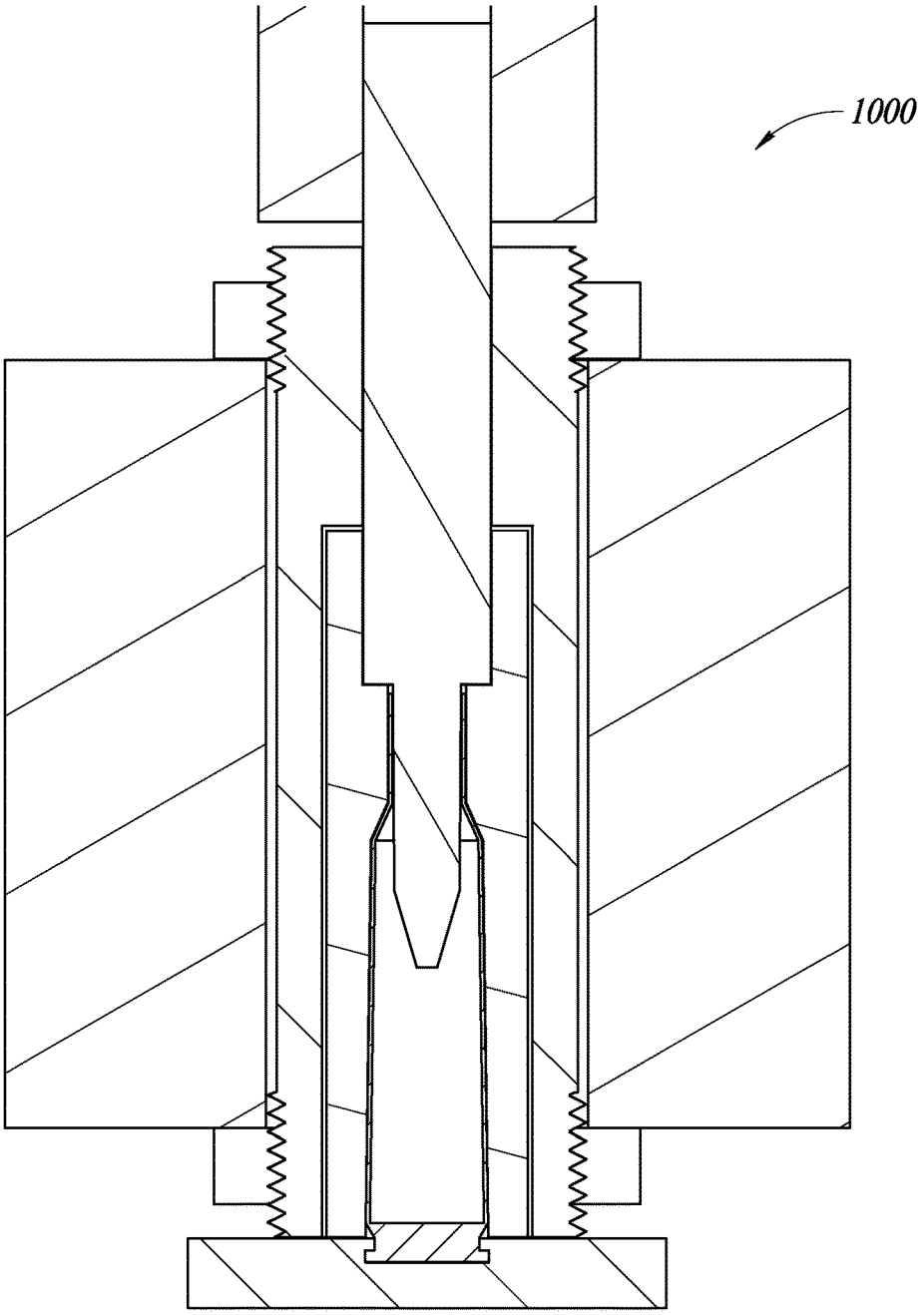

As an example, FIG. 10C includes illustrating a cross-sectional view of a casing fully inserted into retainer and die 210. Prior to fully inserting the casing, it was inserted partially into the die, the mandrel expanding the brass outwards. To fully insert the casing, a receiving base 140 may apply a burst of pressure, such as to prevent case opening 925 from catching on the case shoulder shaping die portion 960. In at least one embodiment, the casing brass as it moves between the mandrel and the die is compressed, which may cause a casing with excess brass to lengthen (which may later be trimmed). As an example, deviations to the casing are modified to the die mold. By introducing more than one step including partial (e.g., using constant pressure) and then full insertion (e.g., burst and/or constant pressure) of the casing, the casing may have fewer anomalies along the case opening 925 and case neck 910. The full insertion into the die helps distribute brass evenly throughout the casing, using the die and mandrel 905.

Figure 10D:
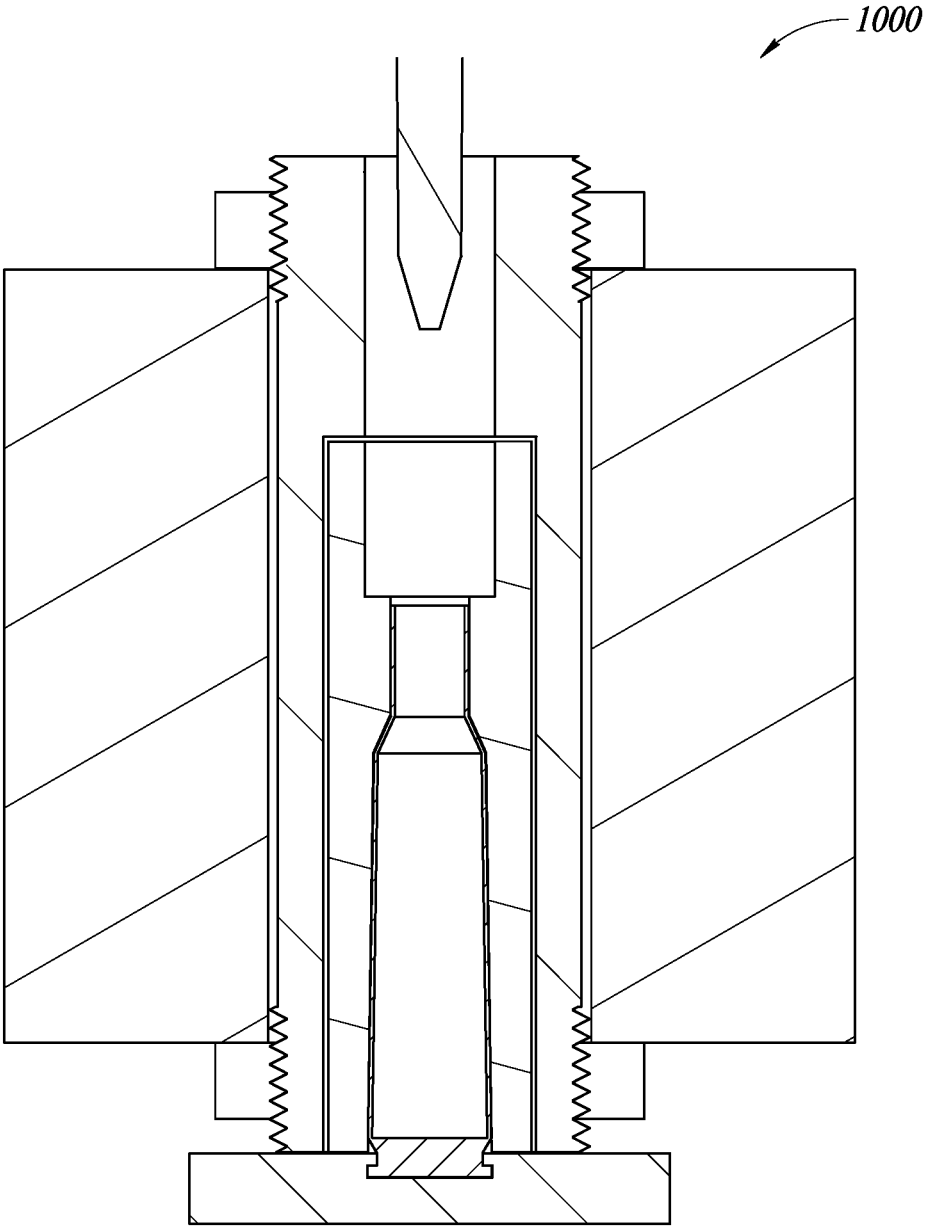

As an example, FIG. 10D includes illustrating a cross-sectional view of extracting a mandrel from a case opening 925, retainer, and die 210. Prior to extraction of the casing, mandrel 905 is extracted.

Figure 10E:
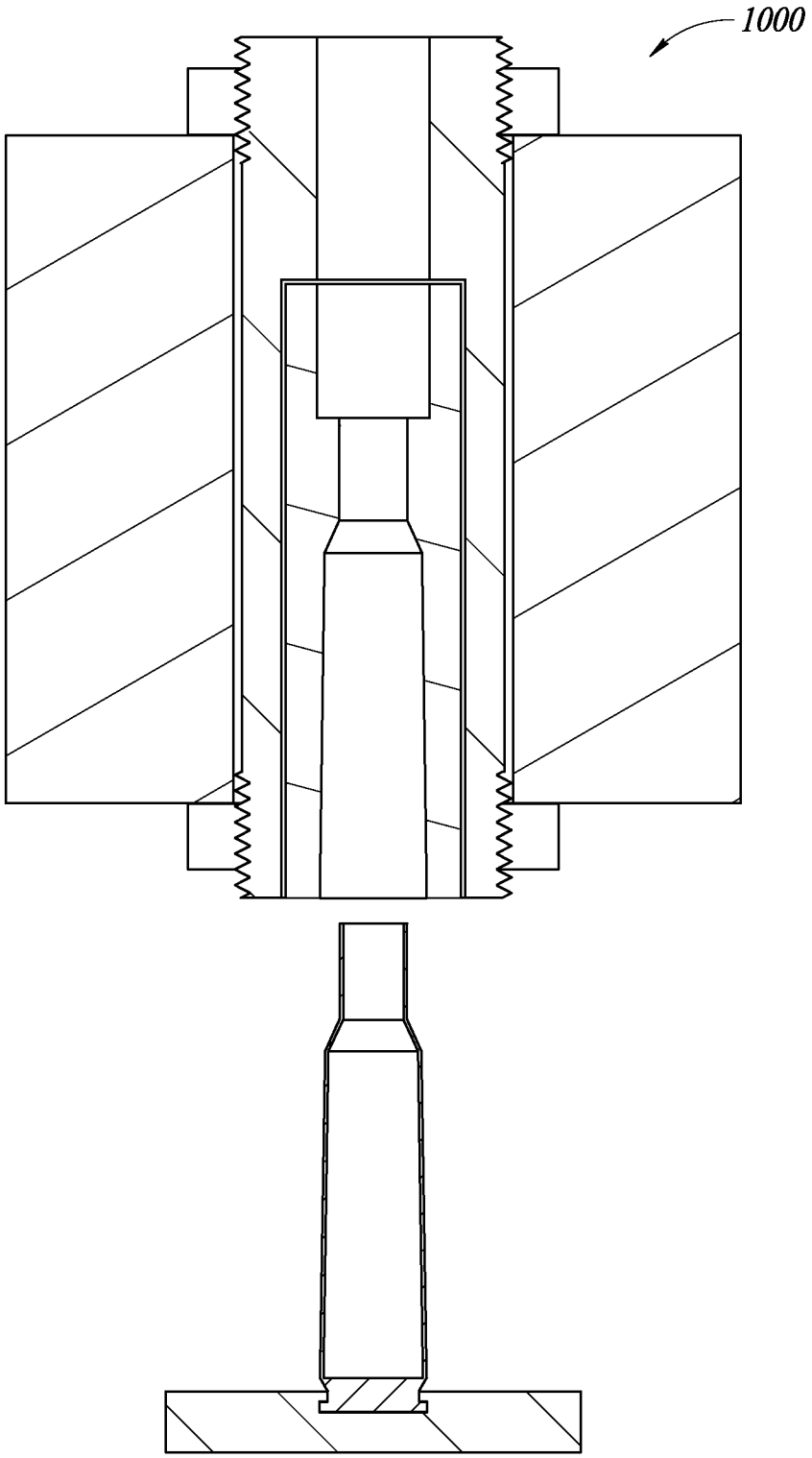

As an example, FIG. 10E includes illustrating a cross-sectional view of extracting a casing from a casing modification system 1000. System 1000 may include a receiving base 140, retainer and die 210, retainer fastener 215, casing (e.g., case neck 910, body 920, opening 925, and/or head 945), case shaping portion set 950 (e.g., a single die or one or more die portions 955, 960, and/or 965). A casing may be extracted from retainer and die 210, which may be a preferred casing shape (e.g., desired casing 1710, 1810, 1910, and/or 2010). FIGS. 10A-10E illustrate a casing modification system 1000, which may be a subsystem of one or more systems described herein (e.g., system 100, 600, 800, and/or 900).

Figure 11A:
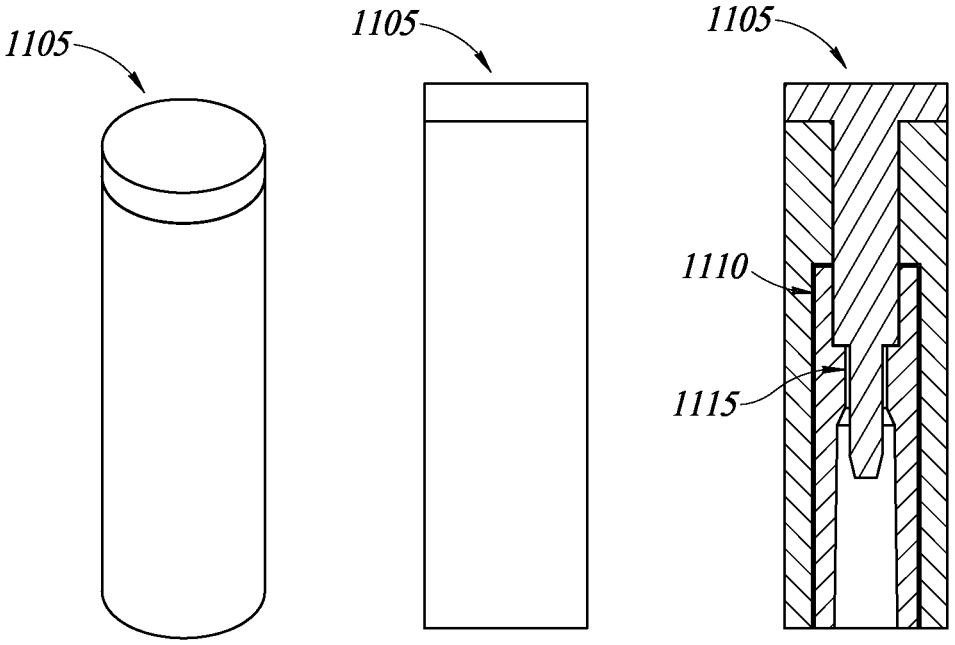
FIGS. 11A, 11B, 11C, and 11D illustrate a schematic diagram of another die system from different perspectives in accordance with at least one embodiment.

FIGS. 11A, 11B, 11C, and 11D illustrate a schematic diagram of another die system from different perspectives in accordance with at least one embodiment. FIGS. 11A-11D include illustrations of casing modification system 1000 which may comprise a die, mandrel, and/or a receiver. For example, FIG. 11A includes casing reshaping system 1105, which may comprise a die 1110 and mandrel 1115. Casing reshaping system 1105 is illustrated in FIG. 11A as having assembled a retainer with a die 1110 inserted, which may be secured (e.g., threading on exterior of die and interior of retainer, adhesive, lock). A die 1110 is a material of a hardness greater than a projectile casing. Mandrel 1115 enters the mandrel chamber of the receiver and into the die 1110, such that a projectile casing may be inserted to modify the projectile casing. Illustrations in FIG. 11A, when viewing drawing from left to right, include an outside view, front view, and cross-sectional view of casing reshaping system 1105. Casing reshaping system 1105 is otherwise illustrated, non-exclusively, in FIGS. 11B-11D.

Figure 11B:
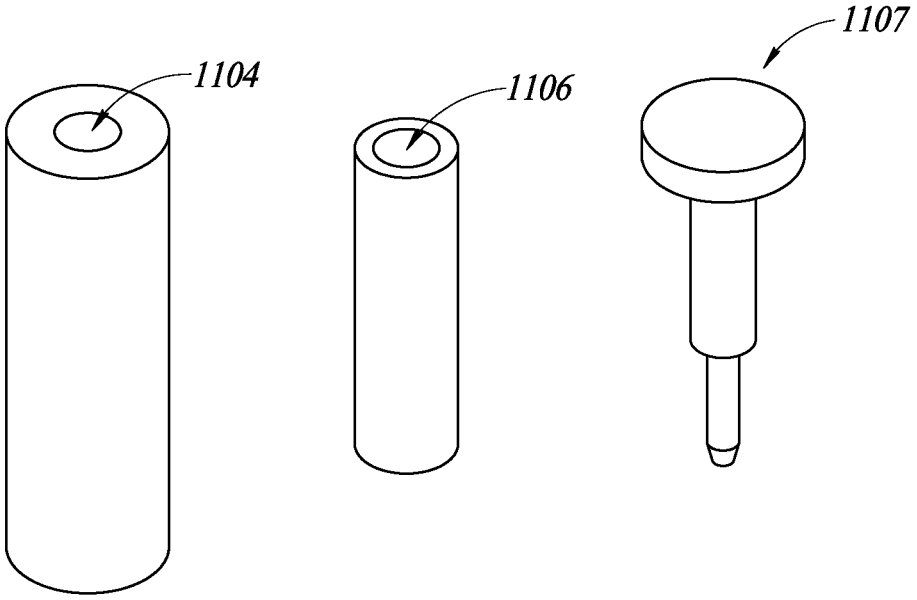
Figure 11C:
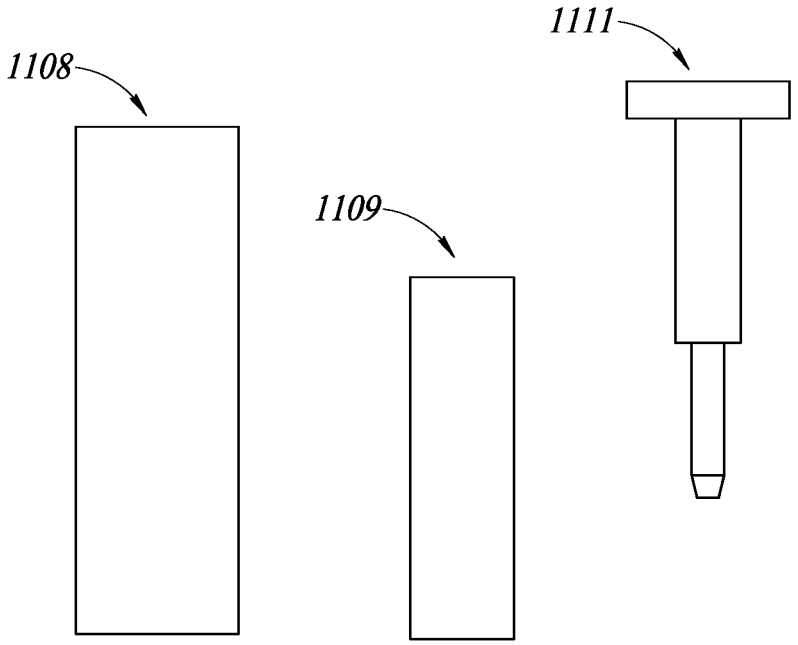
Figure 11D:
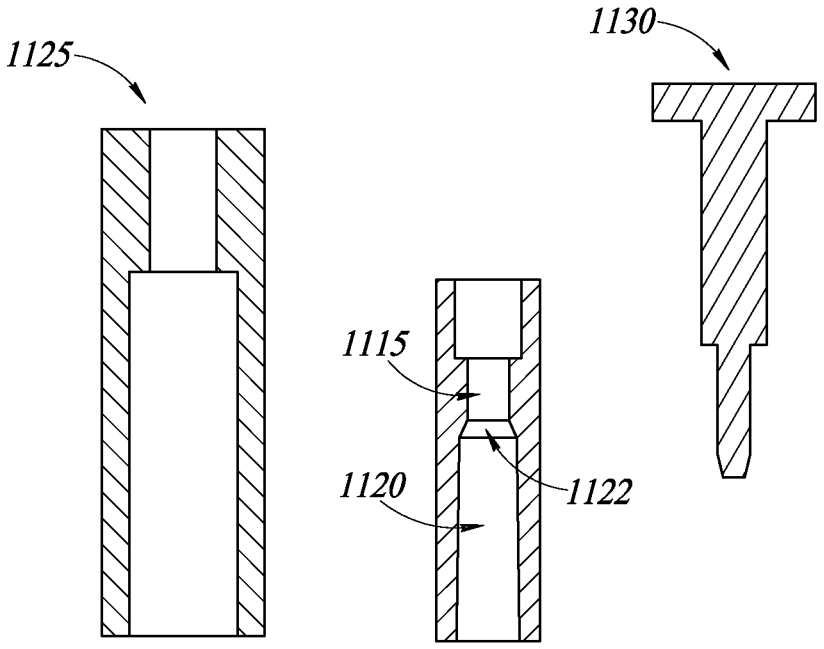

FIG. 11B includes illustrations of a casing reshaping system 1105, which may comprise a die 1106, mandrel 1107, and receiver 1104. The die 1106, mandrel 1107, and receiver 1104 illustrated are separate, illustrated by a view of an outside perspective. FIG. 11C includes front view illustrations of a casing reshaping system 1105, which may comprise a die 1109, mandrel 1111, and receiver 1108. As an example, FIG. 11D includes a cross sectional diagram of a die (e.g., comprising die portions to shape neck 1115, body 1120, and/or shoulders 1122), mandrel 1130, and receiver 1125. FIGS. 11A-11D illustrate a casing reshaping system 1105, which may be a subsystem of one or more systems described herein (e.g., system 100, 600, 800, 900, and/or 1000).

Figure 12A:
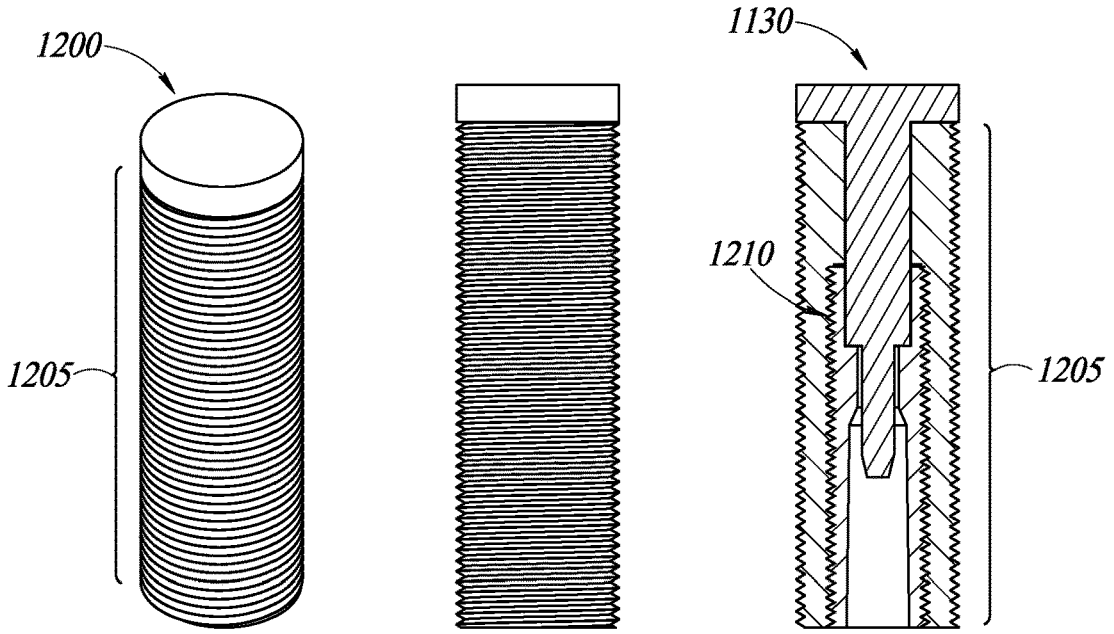
FIGS. 12A, 12B, 12C, and 12D illustrate a die system with threads in accordance with at least one embodiment.

FIGS. 12A, 12B, 12C, and 12D illustrate a die system 1200 with threads in accordance with at least one embodiment. FIG. 12A includes illustrations of a threaded die system 1200 assembled from a perspective, face view, and cross-sectional view. A die may include die threading 1210 externally, such as to fasten into or extract from a retainer. This may include applications to replace a die and/or exchange a die for a different casing shape (e.g., different caliber of a casing, longer neck, different casing shoulders, and/or differing casing body). In at least one embodiment, a die comprises one or more die portions, such as to assemble a casing set as illustrated in FIGS. 13A-13D.

Figure 12B:
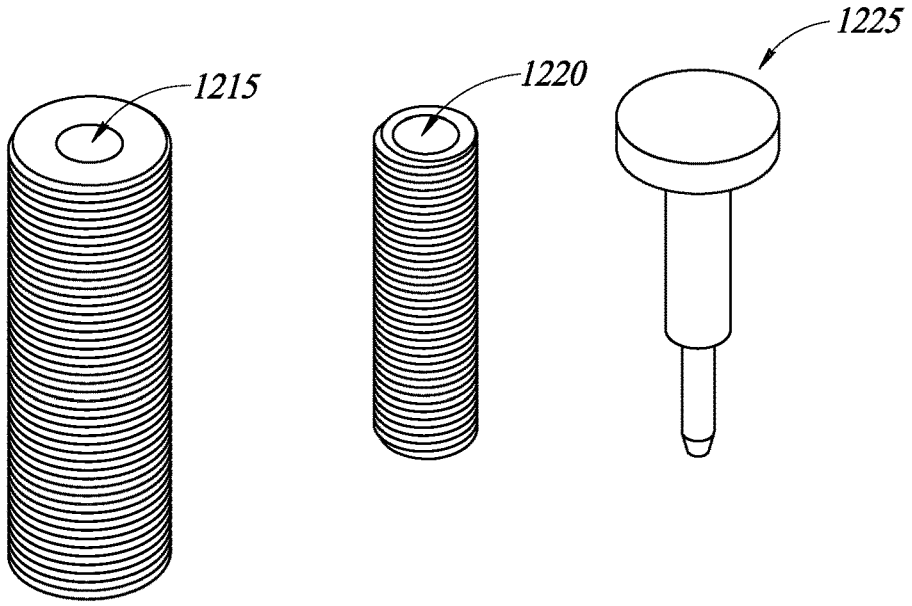

FIG. 12B includes illustrations from an outside perspective of a threaded die system 1200 disassembled including a threaded retainer 1215, threaded die 1220, and mandrel 1225. A threaded retainer 1215 may include threading on its interior, exterior, or both. As an example, a threaded die 1220 may be inserted into a threaded retainer's 1215 interior. In at least one embodiment, a threaded die 1220 comprises one or more die portions, such as to assemble a die casing set as illustrated in FIG. 13A-D.

Figure 12C:
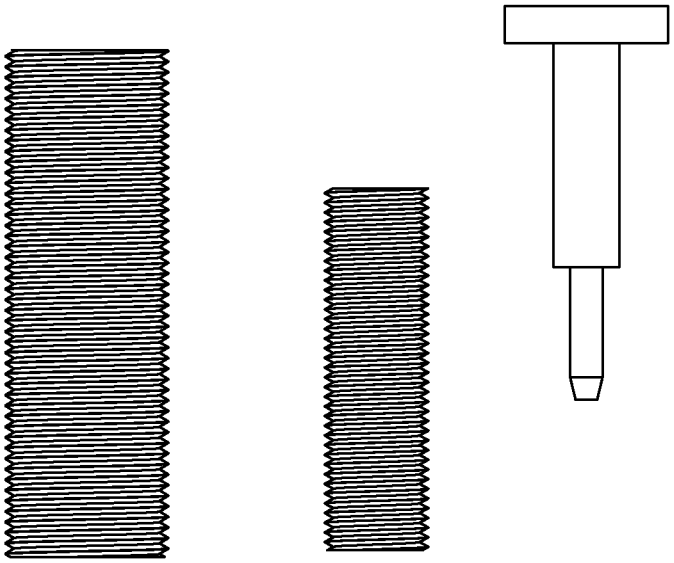
Figure 12D:
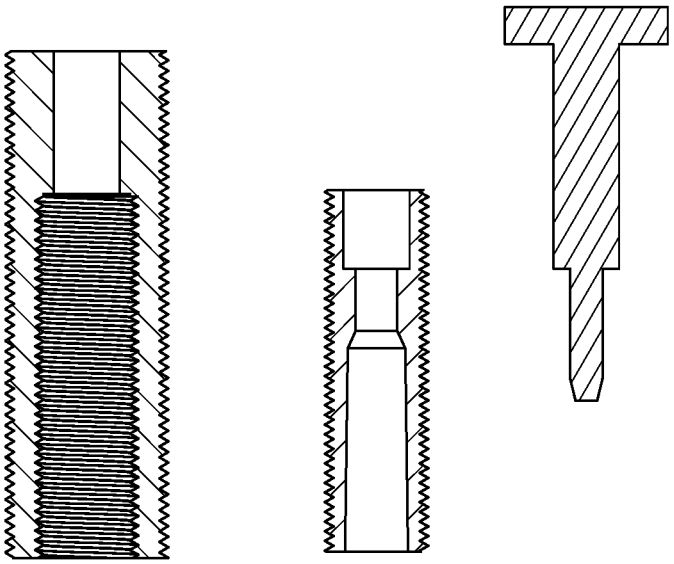

FIG. 12C includes illustrations from a face view of a threaded die system 1200 disassembled including a threaded retainer 1215, threaded die 1220, and mandrel 1225. FIG. 12D includes illustrations from a cross-sectional view of a threaded die system 1200 disassembled including a threaded retainer 1215, threaded die 1220, and mandrel 1225. In at least one embodiment, a system 1200 comprises a mandrel (e.g., mandrel 1130 and/or 1225), threaded retainer 1215 including threading 1205, and/or threaded die 1220 including threading 1210. FIGS. 12A-12D illustrate a system, which may be a subsystem of one or more systems described herein (e.g., system 100, 600, 800, 900, and/or 1000).

Figure 13A:
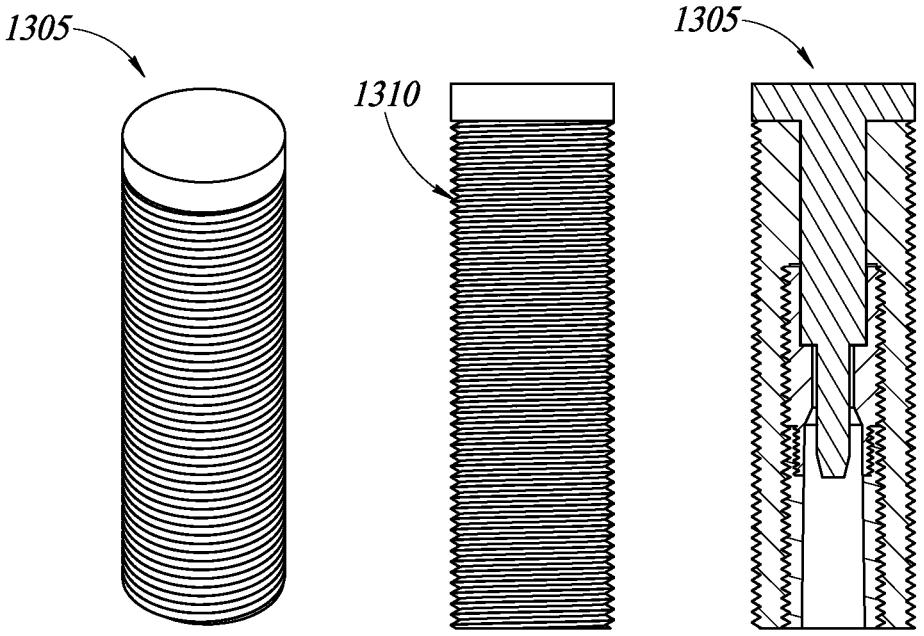
FIGS. 13A, 13B, 13C, and 13D illustrate a die system with threads in accordance with at least one embodiment.

FIGS. 13A, 13B, 13C, and 13D illustrate a die system with threads in accordance with at least one embodiment. FIGS. 13A-13D include illustrations of portions of a threaded die, which may be used in connection with systems using a die herein. As an example, FIG. 13A illustrates an assembled die system including a mandrel 1305, threaded receiver 1310, and one or more die portions. As an example, lines in the center of the die may illustrate a die with two portions assembled as a die set. In at least one embodiment, FIGS. 13A, 13B, 13C, and 13D include portions that are interchangeable or can be replaced by other portions. For example, a first portion of the die system can include interior portions with dimensions for one size or one shape of a projectile casing (e.g., size of casing, length of neck, shape of shoulder, length of shoulder) and it can replaced with a third portion, which still fits or can be used with the second portion (e.g., by screwing in/out different portions). In at least one embodiment, the die system can include many (e.g., 2, 3, 4, 10, or 20) interchangeable third portions, wherein the third portion and the first portion include interior portions with different diameters and different dimensions for different projectile casings. For example, if a marksman wants to shoot a different casing (e.g., different size, length, diameter), the marksman can use a different (but interchangeable) portion of the die system and screw it into another portion to make a snug (e.g., flush) fit between the sections. In this way, the marksman can continue to change the portions of the die system while keeping a tight and stable fit (e.g., threaded, and flush it within 1/1000 inches or less) between the portions such that the shaping and/or resizing of the casing is accurate and flexible (e.g., based on desired casing properties such has neck, shoulder, and body casing sizes and lengths). In at least one embodiment, interchange the die system avoids a free floating die or portion of the die because the first and second portions are secured together with threads.

Figure 13B:
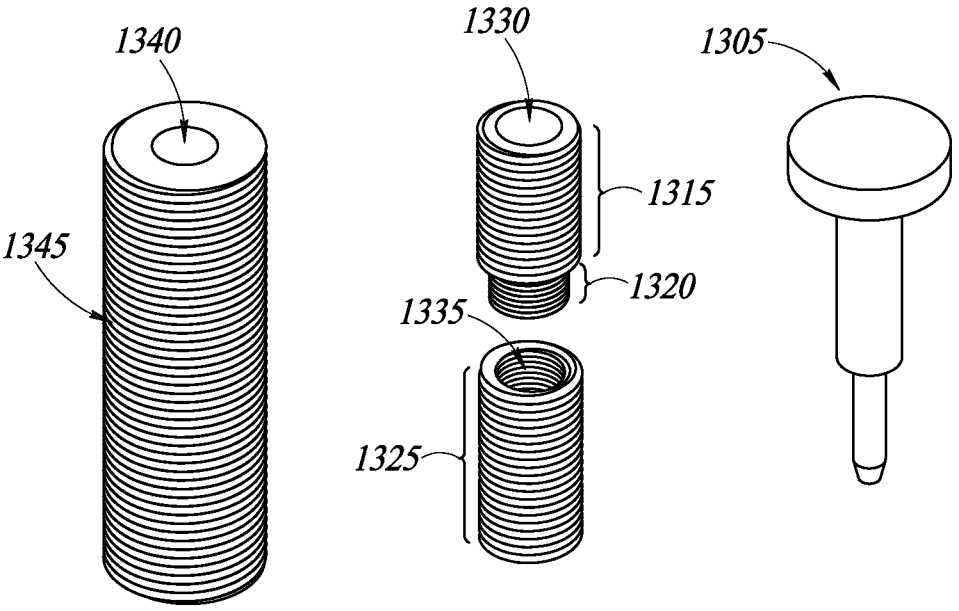

FIG. 13B includes an illustration of a disassembled die system including a threaded receiver 1340, casing die portion set 1330, and mandrel 1305. A receiver may include threading 1345, such as to connect to a die plate. A casing die portion set 1330 may otherwise be a single die or a combination of die. For example, a die portion set 1330 comprises one or more portions, such as a first die portion 1315 and a second die portion 1325. Die portions (e.g., a first die portion 1315 and second die portion 1325) may connect (e.g., to form a casing die portion set 1330), such as by using threading 1320 on the exterior of a first die portion 1315 and threading 1320 on the interior of a second die portion 1325 (e.g., threaded receiving die end 1335).

Figure 13C:
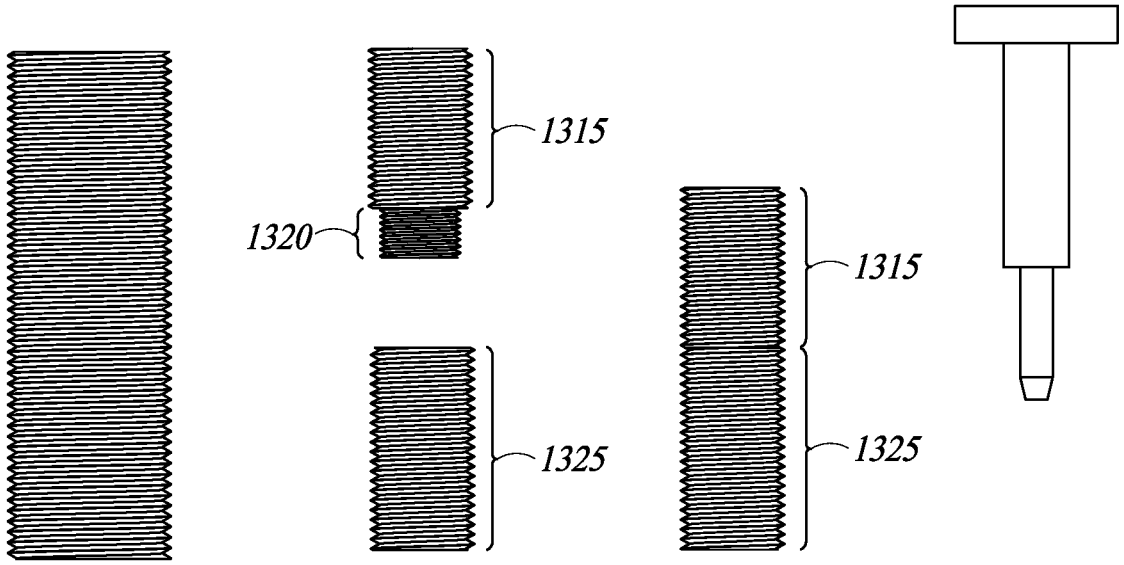

FIG. 13C includes a face view illustration of a disassembled die system including a threaded casing die portion set 1330 assembled and disassembled. For example, a second die portion 1325 is connected to a first die portion 1315 using threading 1320. A die (e.g., die set) may be comprised of one or more connected (e.g., threading, adhesive, a lock, and/or combinations thereof) by a section of one or more portions. In at least one embodiment, a die is to modify a projectile casing, the die comprising: a first portion of a die including a first set of threads on a first exterior surface of the first portion, wherein the first portion has a first section and a second section, wherein the first portion includes the first set of threads, and wherein the first section has a diameter that is larger than a diameter of the second section, and wherein the second section includes a second set of threads on second exterior surface; a second portion of the die including a third set of threads on an exterior surface of the second portion, wherein the second portion forms a hole to receive the second section of the first portion, wherein the second section is to screw into the second portion, and/or otherwise perform operations described herein.

Figure 13D:
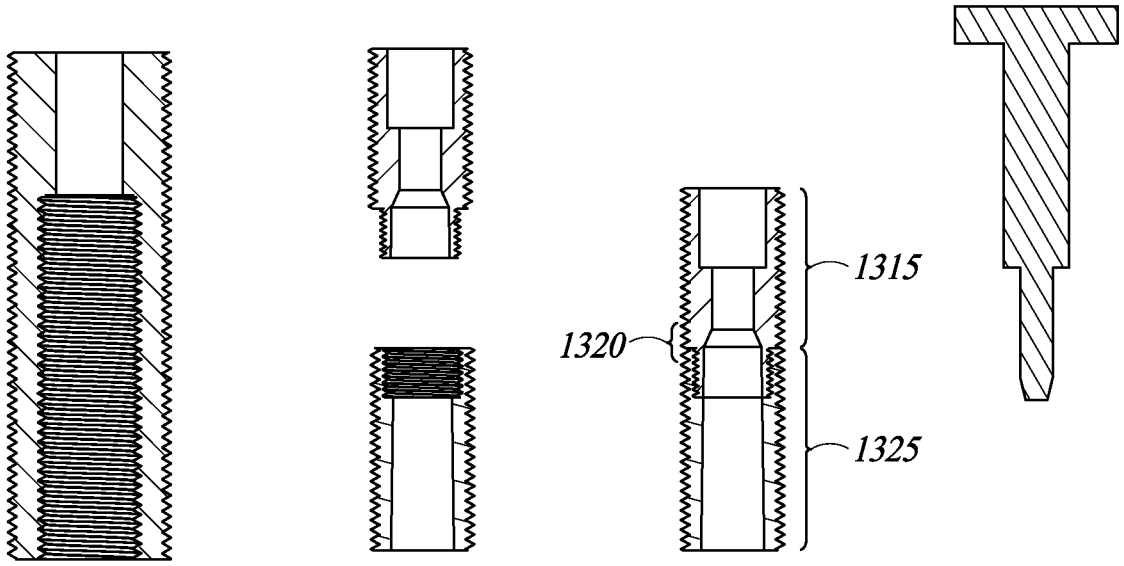

FIG. 13D includes a cross-sectional view illustration of a disassembled die system including a threaded casing die portion set 1330 assembled and disassembled. For example, a first die portion 1315 is connected to a second die portion 1325 using threading 1320. One or more portions (e.g., a first die portion 1315 and second die portion 1325) may connect at the chamber for the body, shoulders, neck, or combinations thereof. FIGS. 13A-13D illustrate a system, which may be a subsystem of one or more systems described herein (e.g., system 100, 600, 800, 900, and/or 1000).

Figure 14A:
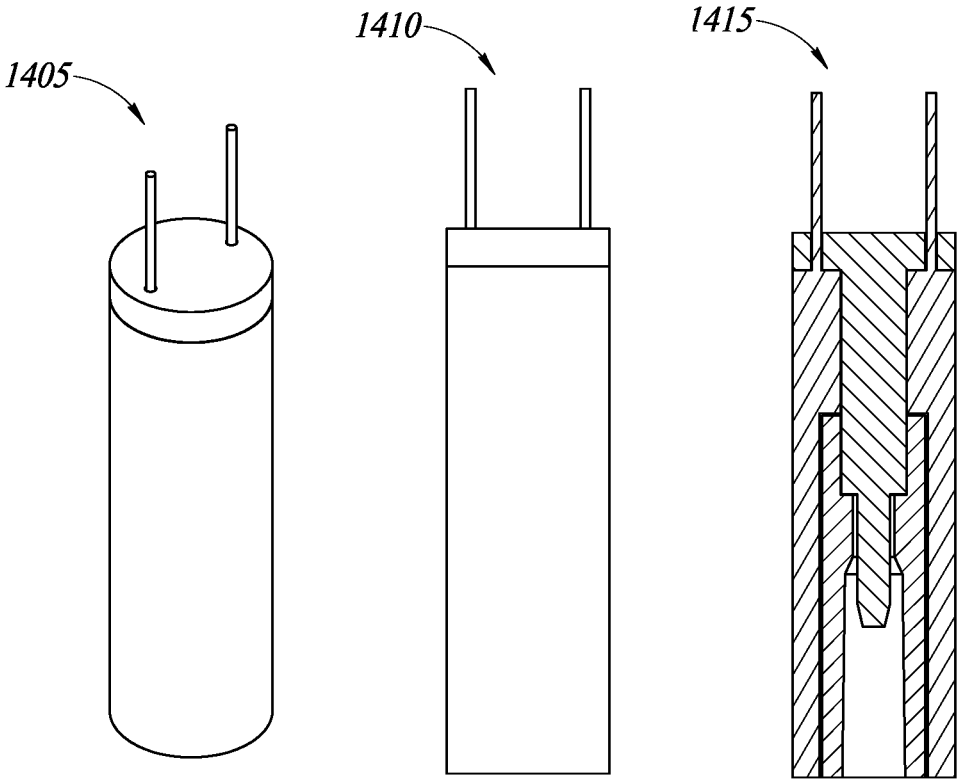
FIGS. 14A, 14B, 14C, and 14D illustrate schematic diagrams of another die system in accordance with at least one embodiment.

FIGS. 14A, 14B, 14C, and 14D illustrate schematic diagrams of another die system in accordance with at least one embodiment. In at least one embodiment, FIG. 14A illustrates the die system based, at least in part, on an adapter (e.g., prongs) from an outside perspective of a system 1405, face view 1410, and cross sectional view 1415. In at least one embodiment, a system 1405 is as otherwise illustrated in FIGS. 7A-7F. A receiver and adapter 1420 (e.g., prongs) guides a mandrel 1430 along an axis of a casing, being inserted perpendicular to a casing base, to perform modification of a casing and/or operations described herein.

Figure 14B:
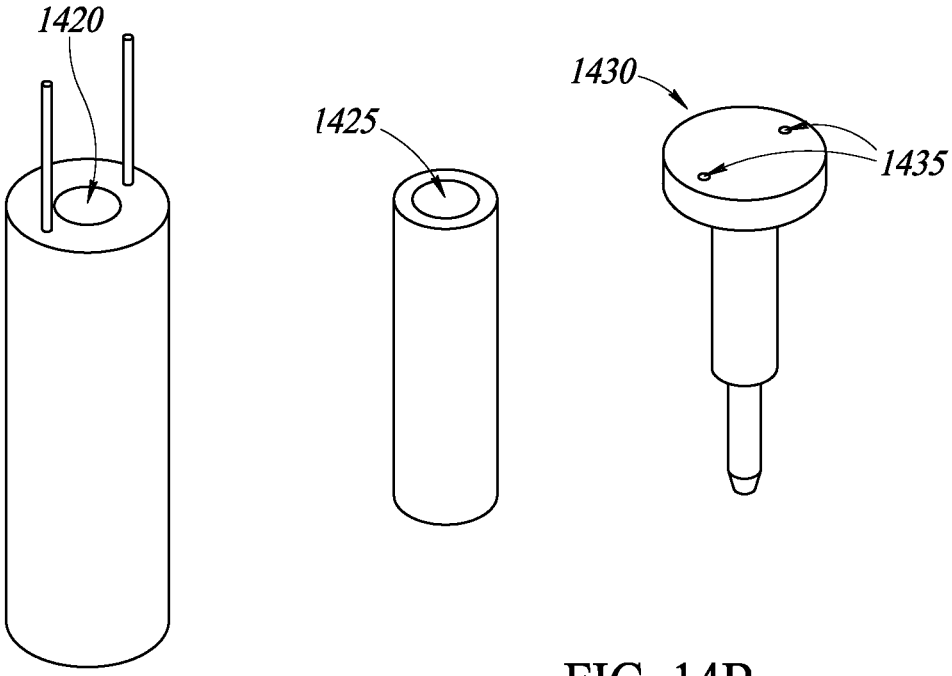
Figure 14C:
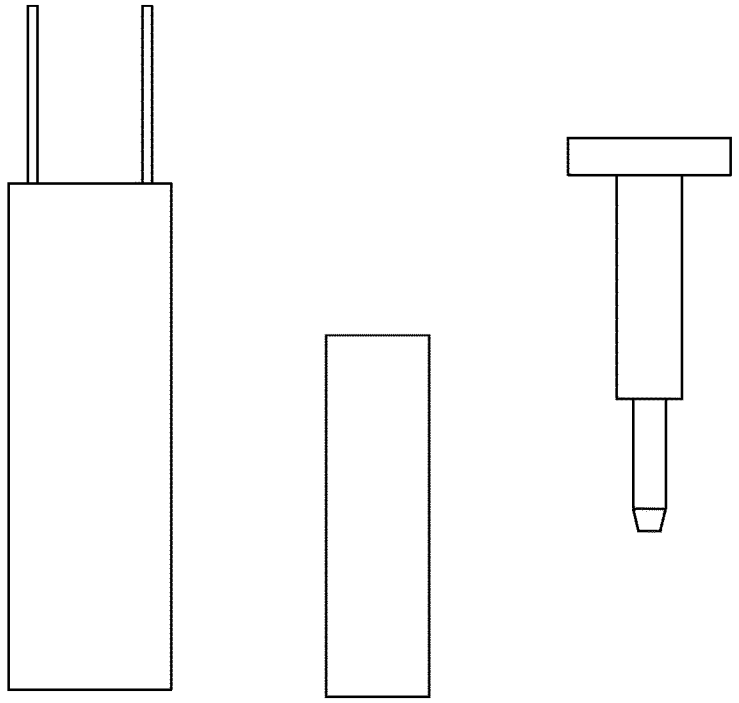
Figure 14D:
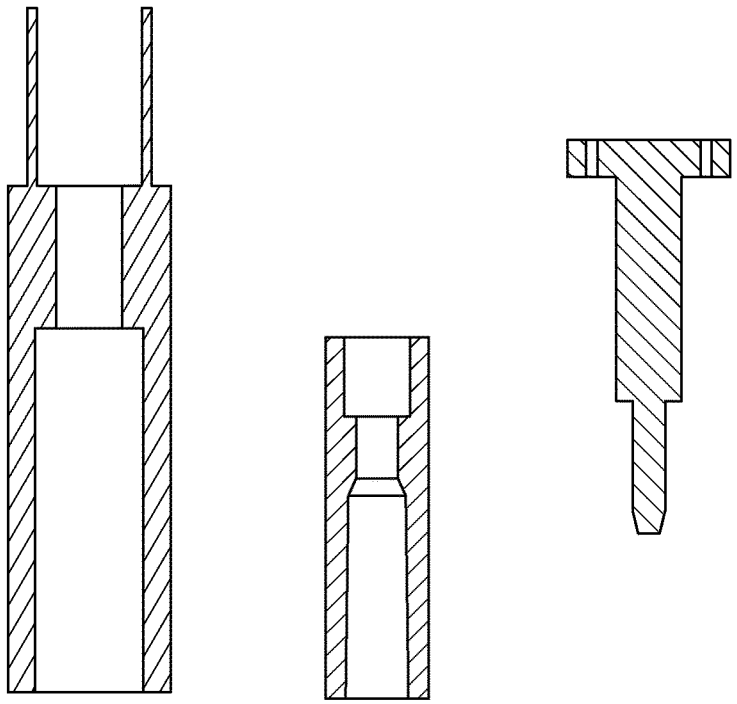

In at least one embodiment, FIG. 14B illustrates the disassembled die system based, at least in part, on an adapter (e.g., prongs) from an outside perspective. The disassembled die system, illustrated in FIG. 14B includes a receiver with an adapter (e.g., prongs), die 1425, mandrel 1430, and adapter holes 1435 (e.g., prong holes). In at least one embodiment, FIG. 14C illustrates the disassembled die system based, at least in part, on an adapter (e.g., prongs) from a front view. In at least one embodiment, FIG. 14D illustrates the disassembled die system based, at least in part, on an adapter (e.g., prongs) from a cross-sectional view. FIGS. 14A-14D illustrate a system, which may be a subsystem of one or more systems described herein (e.g., system 100, 600, 800, 900, and/or 1000).

Figure 15A:
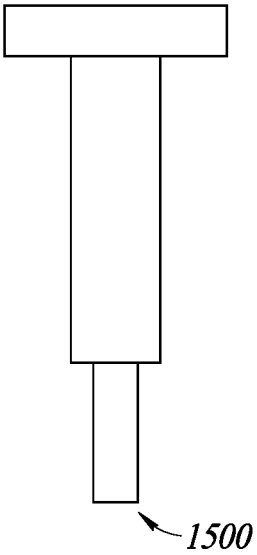
FIGS. 15A, 15B, 15C, 15D, 15E, and 15F illustrate schematic diagrams of mandrels in accordance with at least one embodiment.
Figure 15B:
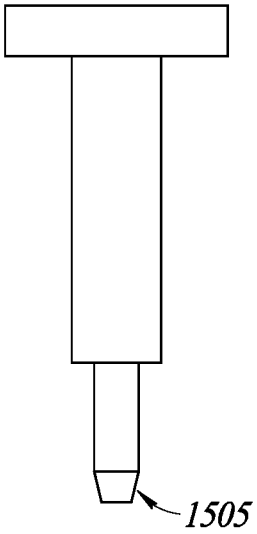
Figure 15C:
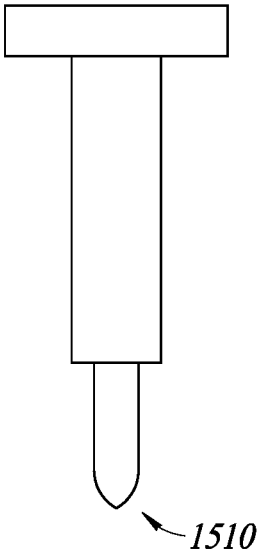
Figure 15D:
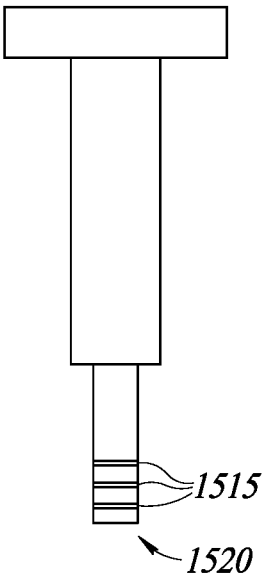
Figure 15E:
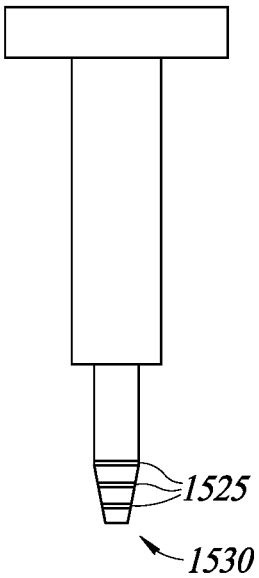
Figure 15F:
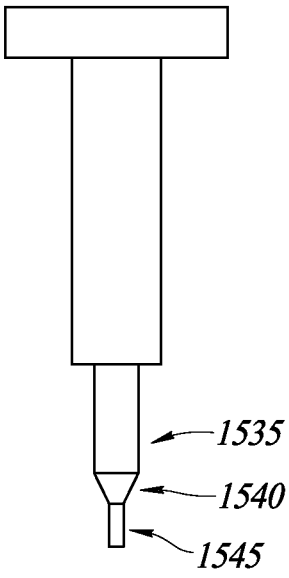

FIGS. 15A, 15B, 15C, 15D, 15E, and 15F illustrate schematic diagrams of mandrels in accordance with at least one embodiment. FIG. 15A illustrates a mandrel including a cylindrical mandrel end 1500. FIG. 15B illustrates a mandrel including a ring mandrel end 1505. FIG. 15C illustrates a mandrel including an expander mandrel end 1510. FIG. 15D illustrates a mandrel including a ribbed mandrel cylindrical end 1520 including mandrel rivets 1515. FIG. 15E illustrates a step mandrel end 1530, including one or more steps 1525. FIG. 15F illustrates a plane mandrel 1535 including a taper 1540 and cylindrical center to make an end 1545 of a diameter less than the mandrel rod. Mandrel ends (e.g., ends 1500, 1505, 1510, 1520, 1530, and/or 1545) may modify a projectile casing, such as to modify an irregular casing (e.g., casing 1705, 1805, 1805, 1905, and/or 2005, see FIGS. 17A, 18A, 19A, and/or 20A) into a preferred casing shape (e.g., desired casing 1710, 1810, 1910, and/or 2010, see FIGS. 17B, 18B, 19B, and/or 20B). A mandrel end (e.g., ends 1500, 1505, 1510, 1520, 1530, and/or 1545) may be used in connection with systems described herein (e.g., system 100, 600, 800, 900, and/or 1000).

Figure 16A:
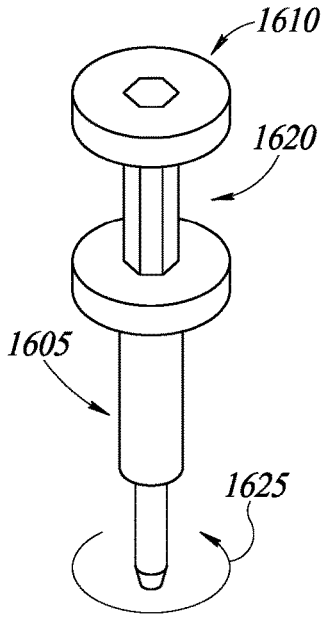
FIGS. 16A, 16B, 16C, 16D, 16E, and 16F illustrate schematic diagrams of mandrels in accordance with at least one embodiment.
Figure 16B:
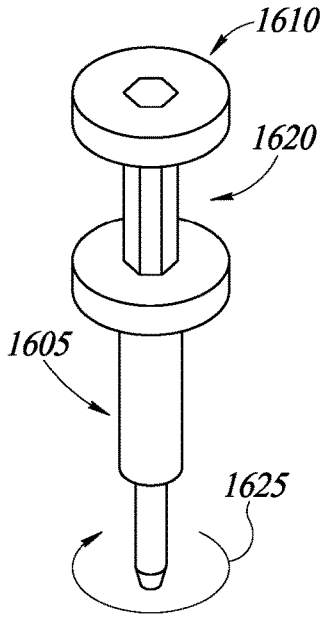
Figure 16C:
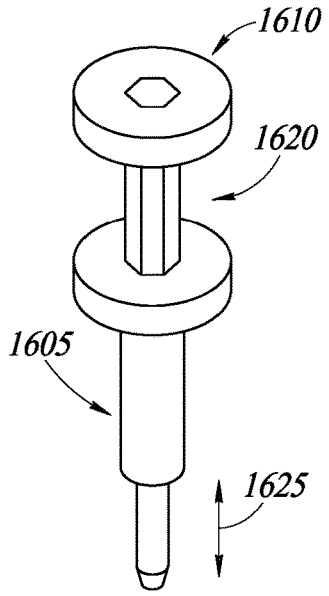
Figure 16D:
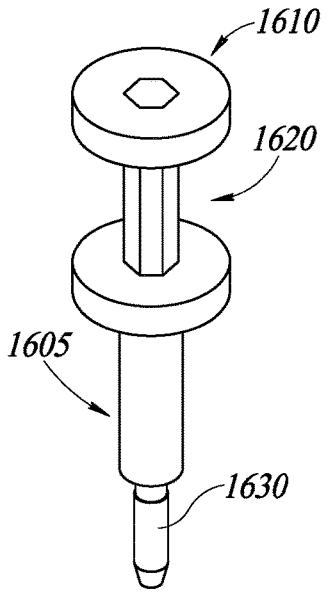
Figure 16E:
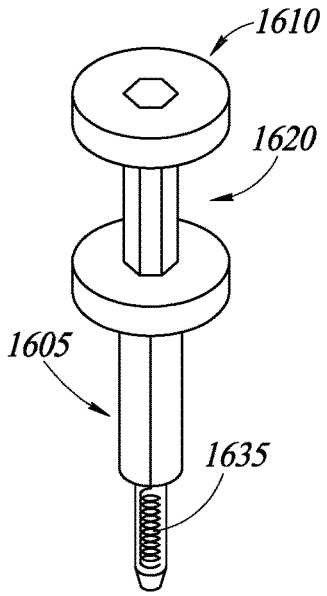
Figure 16F:
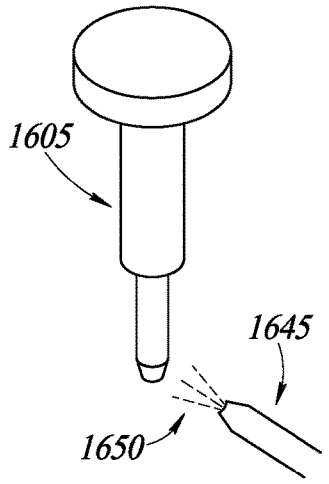
Figure 17A:
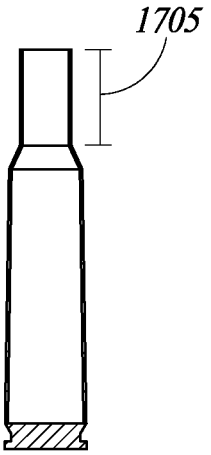
FIGS. 17A, 17B, 18A, 18B, 19A, 19B, 20A, and 20B illustrate a deformed bullet casing and modified bullet casing in accordance with at least one embodiment.
Figure 17B:
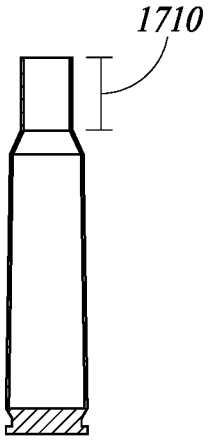
Figure 18A:
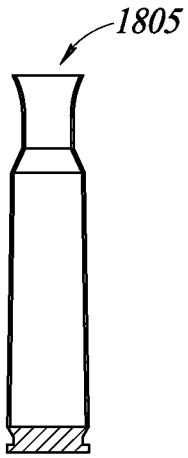
Figure 18B:
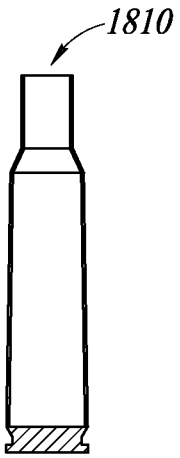
Figure 19A:
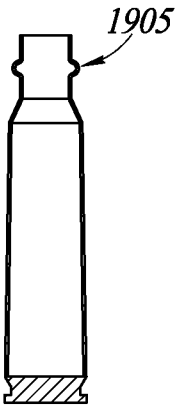
Figure 19B:
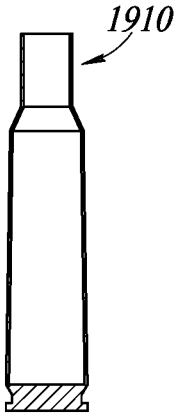
Figure 20A:
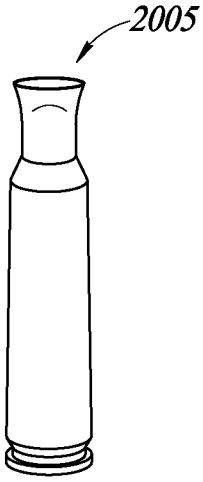
Figure 20B:
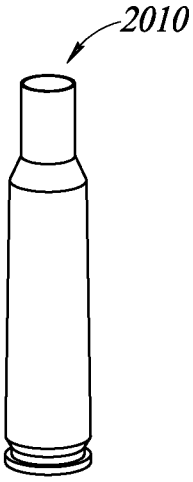

FIGS. 16A, 16B, 16C, 16D, 16E, and 16F illustrate schematic diagrams mandrels in accordance with at least one embodiment. FIG. 16A illustrates mandrel movement (e.g., counterclockwise rotation), including a mandrel rod 1605, mandrel connector 1610, and mandrel receiver 1620. FIG. 16B illustrates mandrel movement (e.g., clockwise rotation), including a mandrel rod 1605, mandrel connector 1610, and mandrel receiver 1620. FIG. 16C illustrates mandrel movement (e.g., tapping, vibration, and/or movement along a vertical axis relative to a casing), including a mandrel rod 1605, mandrel connector 1610, and mandrel receiver 1620. FIG. 16D illustrates a changeable mandrel end 1630, including a mandrel rod 1605, mandrel connector 1610, and mandrel receiver 1620. FIG. 16E illustrates mandrel movement 1635 (e.g., spring), including a mandrel rod 1605, mandrel connector 1610, and mandrel receiver 1620. FIG. 16F illustrates lubrication 1650 (e.g., using a lubricant) of a mandrel rod 1605 using a lubricator 1645. A mandrel may use mandrel movement (e.g., mandrel movement 1625 and/or 1635) for shaping purposes, such as to modify a projectile casing and/or perform operations described herein. In at least one embodiment, a mandrel is heated based, at least in part, on shaping a casing. Lubrication 1650 of a mandrel may also be used to support mandrel movement (e.g., mandrel movement 1625 and/or 1635). In at least one embodiment, a mandrel includes a coating to assist (e.g., lubrication, rust repellant, and/or texturization) in modifying a casing and/or perform operations described herein. Mandrel movement 1625 and/or 1635 may be used in connection with systems described herein (e.g., system 100, 600, 800, 900, and/or 1000).

FIGS. 17A, 17B, 18A, 18B, 19A, 19B, 20A, and 20B illustrate a deformed bullet casing and modified bullet casing in accordance with at least one embodiment. FIGS. 17B, 18B, 19B, and 20B illustrate a desired casing (e.g., desired casing 1710, 1810, 1910, and 2010). FIGS. 17A, 18A, 19A, and 20A illustrate a casing which may be deformed, such as with an irregularity (e.g., long neck casing 1705, outwardly bent casing 1805, doughnut shaped casing 1905, and/or irregular elliptical casing) to be modified. A modified casing may be of a desired casing 2010 shape (such as a die's chamber shape). As an example, a deformed bullet casing is input into a system (e.g., system 100, 600, 800, 900, and/or 1000). A deformation of a casing (e.g., deformed casing 1705, 1805, 1905, and/or 2005) may have occurred due to it being an expelled casing priorly used, such as concussion of the gas from igniting the powder. As an example, a deformation of a casing may have occurred due to a manufacturer irregularity from a desired casing shape (e.g., desired casing 1710, 1810, 1910, and/or 2010). A deformed casing (e.g., deformed casing 1705, 1805, 1905, and/or 2005) may include deformations not illustrated, such as any irregularity deviating from a desired casing (e.g., desired casing 1710, 1810, 1910, and 2010). A system (e.g., system 100, 600, 800, 900, and/or 1000) may then modify a casing and/or perform operations described herein to where a system may output a desired casing (e.g., desired casing 1710, 1810, 1910, and 2010).

Figure 21:
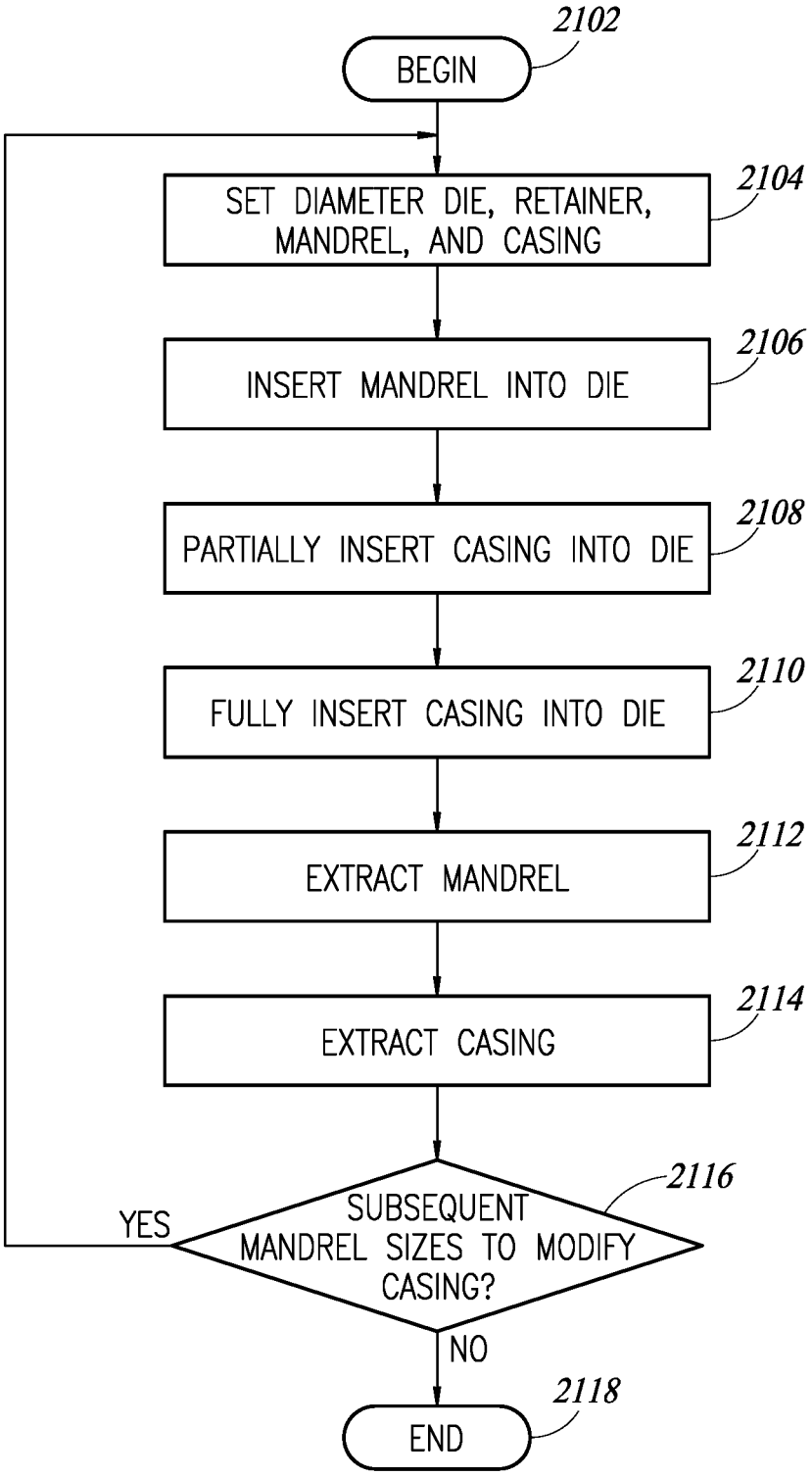
FIG. 21 is a process flow diagram illustrating using one or more dies to modify a casing in accordance with at least one embodiment.

FIG. 21 is a process flow diagram illustrating using one or more dies to modify a casing in accordance with at least one embodiment. In at least one embodiment, FIG. 21 includes an algorithm for shaping, resizing, and otherwise modifying a projectile casing, where the algorithm can be stored in memory performed by a processor to cause machines to perform operations or provide instructions. A process illustrated in FIG. 21 may include one or more steps to set the diameter of the die, retainer, mandrel, and casing 2104; insert mandrel into die 2106; partially insert casing into die 2108; fully insert casing into die 2110 (e.g., such that there is a snug fit between the walls of the casing, the walls of the mandrel, and the walls of the die, e.g., friction and pressure are used to shape the projectile casing); extract mandrel 2112; and/or extract casing 2114. In at least one embodiment, a process may begin 2102 once invoked and/or otherwise begin 2102 by performance of one or more steps described. In at least one embodiment, some or all of process (or any other processes described herein, or variations and/or combinations thereof) is performed under control of one or more computer systems configured with computer executable instructions and is implemented as code (e.g., computer executable instructions, one or more computer programs, or one or more applications) executing collectively on one or more processors, by hardware, software, or combinations thereof. In at least one embodiment, code is stored on a computer-readable storage medium in form of a computer program comprising a plurality of computer-readable instructions executable by one or more processors. In at least one embodiment, a computer-readable storage medium is a non-transitory computer-readable medium. In at least one embodiment, at least some computer-readable instructions usable to perform process are not stored solely using transitory signals (e.g., a propagating transient electric or electromagnetic transmission). In at least one embodiment, a non-transitory computer-readable medium does not necessarily include non-transitory data storage circuitry (e.g., buffers, caches, and queues) within transceivers of transitory signals. In at least one embodiment, process is performed at least in part on a computer system such as those described elsewhere in this disclosure. In at least one embodiment, logic (e.g., hardware, software, or a combination of hardware and software) performs process. A process may be performed by one or more systems illustrated herein, such as system 100, 600, 800, 900, and/or 1000. In at least one embodiment, the process illustrated in FIG. 21 can be performed by an operator (e.g., person working at home or at casing manufacturing facility) or a operation working with a system such that those systems described herein.

A process may include a step to set a diameter die, retainer, mandrel, and casing. This may include choosing a die, or combining die portions, to create a die corresponding to a desired projectile casing shape, size, or design physical property of the projective casing (e.g., length, thickness of part of casing). The system, such as system 100, may have a retainer and die fastened into a die plate, and aligned with both a casing and mandrel. When the components of a system are set, such as by setting a diameter of a die, retainer, mandrel, and casing 2104, then a system may insert the mandrel into the die 2106. For example, a hydraulic pump or person can insert the mandrel into the die 2106. A chamber of the neck portion of a die may receive the mandrel.

To modify a casing, it may be partially inserted into the die 2108, where a mandrel can expand the casing (e.g., expand its diameter) or a mandrel may be tapered such that its lower portion fits into a casing. A die may compress a casing towards the mandrel as the casing is moved up and inserted into the die, where the mandrel is the center of casing hole helps shape the diameter of the hole (e.g., to make it uniform). In at least one embodiment, a marksman select a die and/or portions of the die based on desired shape and/or size of the projectile casing. Specifically, a die can include portions that are interchangeable or can be replaced by other portions to match a desired projectile casing. For example, a first portion of the die system can include interior portions with dimensions for one size or one shape of a projectile casing (e.g., size of casing, length of neck, shape of shoulder, length of shoulder) and it can replaced with a third portion, which still fits or can be used with the second portion (e.g., by screwing in/out different portions). In at least one embodiment, the die system can include many (e.g., 2, 3, 4, 10, or 20) interchangeable third portions, wherein the third portion and the first portion include interior portions with different diameters and different dimensions for different projectile casings. For example, if a marksman wants to shoot a different casing (e.g., different size, length, diameter), the marksman can use a different (but interchangeable) portion of the die system and screw it into another portion to make a snug (e.g., flush) fit between the sections. In this way, the marksman can continue to change the portions of the die system while keeping a tight and stable fit (e.g., threaded, and flush it within 1/1000 inches or less) between the portions such that the shaping and/or resizing of the casing is accurate and flexible (e.g., based on desired casing properties such has neck, shoulder, and body casing sizes and lengths). In at least one embodiment, interchange the die system avoids a free floating die or portion of the die because the first and second portions are secured together with threads. In at least one embodiment, interchangeable die includes two or more portions of the die that can be switched, exchanged, or otherwise replaced by unscrewing a portion of the die and screwing in a different portion of the die, where the different portion has different interior dimensions and/or shapes such that it can modify, shape, resize, or otherwise change projectile casing (e.g., a marksman can used a series of dies to modify, shape, or otherwise size a projectile casing where the series includes different portions with progressively differently dimensions). For example, a marksman can change portions of the die based on caliber, size, or different types of desired shapes and/or sizes of projectile casing and a respective projectile.

Then the system may fully insert the casing, applying the same or a differing amount of force to the casing to insert into the die 2110. At this step, a casing may then have brass modified between the mandrel and die. Once a casing is inserted at least partially, such that the neck of a casing is fully inserted into die 2110, a casing may then be modified according to a die and mandrel. Then a system extracts a mandrel 2112, followed by extracting a casing 2114. However, in certain instances, such as when a casing is too narrow in diameter, it may be desirable to use more than one diameter mandrel to modify a casing. After a casing is extracted, such as by being moved away from a die (e.g., using a hydraulic cylinder), the system may then repeat setting a diameter die, retainer, mandrel and the casing 2104 with a differing mandrel diameter. For example, in decision block 2116, a decision is "YES," if there are one or more subsequent mandrel sizes to modify a casing. Otherwise, a decision in decision block 2116 may be "NO." If "YES," a process proceeds to set the diameter die, retainer, mandrel, and casing 2104 to repeat one or more steps 2104-2116 with a different diameter of a mandrel (e.g., to expand to a diameter than previous mandrel used). In at least one embodiment, a process is repeated to use different applications of a mandrel, (e.g., mandrel movement), as illustrated in FIGS. 16A-16F. If a decision in decision block 2116 is "NO," a process may proceed to end 2118 and/or otherwise perform operations described herein. In at least one embodiment, a system (e.g., system 100, 600, 800, 900, and/or 1000) performs a process illustrated in FIG. 21, such as to secure a projectile casing on a base; insert a mandrel in a die by moving the mandrel towards the die, wherein the die includes a region to shape a neck section of a projectile casing; while the mandrel is fully inserted into the die, being inserted, at least partially, a projectile casing is inserted into the die; and wherein inserting the projectile casing into the die includes moving the projectile casing towards die while the die is secured to a support structure; after the projectile casing has been inserted into the die, extracting the mandrel away from the projectile casing, wherein extracting the mandrel away from the projectile casing includes moving the mandrel away from a base section of the projectile casing towards the hole of the projectile casing until the mandrel is completely outside of the projectile casing; and/or perform operations described herein.

What is claimed is:

1. A die to modify a projectile casing, the die comprising:

a first portion of a die including a first set of threads on a first exterior surface of the first portion, wherein the first portion has a first section and a second section, wherein the first portion includes the first set of threads, and wherein the first section has a diameter that is larger than a diameter of the second section, and wherein the second section includes a second set of threads on a second exterior surface; and a second portion of the die including a third set of threads on an exterior surface of the second portion, wherein the second portion forms a hole to receive the second section of the first portion, and wherein the second section is to screw into the second portion.

2. The die of claim 1, further comprising:

an outer shell forms a hole to receive the first and second portions of the die, wherein the outer shell includes a fourth set of threads on an exterior surface of the outer shell.

3. The die of claim 1, wherein the first portion includes an interior section to modify a neck section of a projectile casing, and wherein the second portion includes an interior section to modify the projectile casing.

4. The die of claim 1, wherein the first portion forms an opening that includes a diameter large enough to receive a mandrel that is to shape a projectile casing.

5. The die of claim 1, wherein the first portion includes an interior section to modify a neck and shoulder section of a projectile casing.

6. The die of claim 1, wherein the first portion is interchangeable with a third portion, wherein the third portion and the first portion include interior portions with different diameters and different dimensions for different projectile casings.

* * * * *